US005666885A

United States Patent [19]

Wike

[11] Patent Number: 5,666,885

[45] Date of Patent: Sep. 16, 1997

[54] LINEAR STEERING TRUCK

[75] Inventor: Paul S. Wike, Los Gatos, Calif.

[73] Assignee: Transportation Investors Service Corporation, Daytona, Fla.

[21] Appl. No.: 560,652

[22] Filed: Nov. 20, 1995

[51] Int. Cl.[6] ..... B61F 5/38

[52] U.S. Cl. ..... 105/168; 105/218.2

[58] Field of Search ..... 105/167, 168, 105/199.1, 218.1, 218.2

[56] References Cited

U.S. PATENT DOCUMENTS

| | | | |
|---|---|---|---|
| 1,931 | 1/1841 | Whitford | 105/167 |
| 95,705 | 10/1869 | McCammon . | |
| 299,735 | 6/1884 | Candee . | |
| 503,831 | 8/1893 | Cooper | 105/167 |
| 642,820 | 2/1900 | Harrison . | |
| 767,182 | 8/1904 | Stephenson . | |
| 767,360 | 8/1904 | Stephenson . | |
| 774,132 | 11/1904 | Best . | |
| 917,522 | 4/1909 | Loucks et al. . | |
| 992,481 | 5/1911 | Clark . | |
| 1,228,131 | 5/1917 | Pynn . | |
| 1,770,174 | 7/1930 | Lichtenbert et al. . | |
| 1,772,928 | 8/1930 | Kijlstra . | |
| 1,828,314 | 10/1931 | Buckius . | |
| 1,877,638 | 9/1932 | Baldwin . | |
| 1,946,409 | 2/1934 | McLintock . | |
| 2,545,956 | 3/1951 | Julien | 105/182 |
| 2,756,690 | 7/1956 | Miller et al. | 105/182 |
| 2,936,720 | 5/1960 | Van Alstine | 105/168 |
| 3,011,458 | 12/1961 | Wirth et al. | 105/196 |
| 3,190,237 | 6/1965 | Hurtner | 105/182 |
| 4,151,801 | 5/1979 | Scheffel et al. | 105/168 |
| 4,294,175 | 10/1981 | Harsy | 105/199 R |
| 4,519,329 | 5/1985 | Vacher | 105/218 |
| 4,628,824 | 12/1986 | Goding et al. | 105/168 |
| 5,024,165 | 6/1991 | Panagin | 105/168 |
| 5,123,358 | 6/1992 | Kemppainen et al. | 105/167 |
| 5,211,116 | 5/1993 | Schneider | 105/168 |
| 5,222,442 | 6/1993 | Tack, Jr. | 105/218.2 |
| 5,249,530 | 10/1993 | Wike | 105/168 |

FOREIGN PATENT DOCUMENTS

| | | |
|---|---|---|
| 368403 | 5/1990 | European Pat. Off. . |
| 1431055 | 5/1966 | France . |
| 2530567 | 1/1984 | France . |
| 2168019 | 6/1986 | United Kingdom . |

*Primary Examiner*—S. Joseph Morano
*Attorney, Agent, or Firm*—Dick and Harris

[57] ABSTRACT

A steerable truck apparatus for railroad cars for providing for the controlled and uniform yawing of the axles of the truck. The truck apparatus provides for a yawing response which is linear substantially throughout the range of movement of the axles. The truck is further configured with pivotably supported pedestals for equalized load distribution. An improved axle bearing construction accommodates pivoting of the axle ends. A damping apparatus provides stiffness in the steering response toward reducing hunting of the wheels during straight line travel.

19 Claims, 13 Drawing Sheets

210
61a
61b
66
62
68
220
61
66
63
69
91
224
212
230
221
66
222
212
212
66
221
230
220
221
212
62a
61c
62
61b
68
62b
61
63b
61a
63a
48
63
91
69

LINEAR STEERING TRUCK

BACKGROUND OF THE INVENTION

1. The Field of the Invention

The present invention relates to the field of trucks for railroad cars, and in particular, to steerable trucks for railroad cars.

2. The Prior Art

The wheels which are used on railroad trucks are, almost universally, formed with conical tapered profiles. That is, the diameters of the wheels decrease, with the portions having the smallest diameter facing outwardly, relative to the railroad car. In addition, rims, having overall diameters substantially greater than the largest diameter portion of the tapered wheel surface, are located at the innermost portions of the wheels, and placed on the truck axles, such that the distance between the rims of the wheels on an axle (collectively, "wheel set") is slightly less than the distance between the inside edges of the rails.

In prior art conventional railroad trucks, the axles would be fixed relative to the truck. Typically, there would be provided two trucks situated adjacent the ends of a railroad car. Each truck is connected to the railroad car by a short, very large diameter (typically 14 or 16 inches) cylindrical post extending downwardly from the carbody, which is received by a "bowl" mounted generally centrally relative to the truck. The center post in such a typical prior art configuration would typically have been configured to permit a certain amount of pivoting of the truck, relative to the railroad car body. As a practical matter, the large frictional forces generated by the large surface contact area between the post and the bowl, and the tremendous weight of the carbody, means that the amount of pivoting will be small, and the resistance to pivoting will be great.

As a railroad car having such prior art trucks would enter a curve, the difference in the radii of curvature of the arcs being followed by the "inside" and "outside" wheels would force the axles of the wheel set to adjust by yawing. The natural tendency of a single axle wheel set, in a curve, is to assume a posture is which the axle "points" to the center of curvature of the curve. This movement of a single axle may be referred to as "going radial". In a prior art two wheel set truck with fixed axles, the axles would not be free to assume this described posture independently of one another, and the truck as a whole would be forced to rotate about the center of the truck. This condition would create high stresses on the wheel sets and the truck, increased wear on the truck components, and increased rolling friction, resulting in increased fuel consumption as a result of the additional energy which had to be expended to keep the railroad cars moving.

An additional drawback to prior art truck configurations was a result of the flexibility which permitted the truck to pivot about the center post during turns. Since the wheel profiles were (and are) conical, during straight line travel, there would be (and is) a tendency of the wheels of a single wheel set to alternately oscillate on their respective rails between "high" and "low" positions on the respective wheel profiles. This oscillation would translate into a force tending to cause the truck, as a whole, to pivot about the center post, thus causing the truck, and the car body, to describe a sinusoidal path along the track. This phenomenon is commonly called "hunting". This instability starts at low speeds and can lead to unacceptable lateral wheel force, acceleration and frequency, unless constrained. The instability transfers rolling energy into undesirable lateral energy which could create rolling resistance, lading and car damage, and wheel and track wear.

A typical prior art truck configuration would comprise two longitudinally extending (i.e., track-wise extending) side frames, with a transversely extending bolster attached to the side frames (the "three-piece truck"). The axles of the wheel sets would be mounted fore and aft of the bolster, with the axle ends being generally fixed relative to the side frames.

Even though nominally rigidly constructed, such a truck configuration would, under sufficient loading (such as during curves), deform. Typically, this deformation would take the form of the side frames, bolster and wheel sets skewing relative to one another to form a parallelogram, as the forces exerted on the wheels push the axles to seek yawed positions through the curve. Such parallelogramming is believed to be a common cause of railroad car derailment at low speed in curves.

Accordingly, it can be seen that making trucks rigid and mounting them rigidly to car bodies (in an effort to eliminate hunting), and providing truck pivoting and/or flexibility, to permit truck or axle yawing or steering in curves, can and have created a design impasse for the creation of an effective three piece truck.

Numerous attempts have been made to produce trucks which satisfy the requirements for efficient rolling during both straight runs and curves. Such attempts have included the provision of resilient or elastic members in the side frames and/or bolsters, pivot-mounted axles and side frames with damping apparatus like shock absorbers, and various forms of cross-bracing and the like. Such prior art configurations typically have resulted in truck structures which are costly, heavy, and/or overly complex and prone to failure or requiring extensive maintenance and replacement of components.

It is an object of the present invention to provide a truck which is configured to permit and accommodate the axles' natural tendency to go radial, so as to permit more efficient and less damaging rolling action in curves.

It is another object of the present invention to provide a truck which is configured to have a reduced tendency to hunt, during straight run travel, so as to reduce the damage and rolling inefficiencies associated with hunting.

It is a further object of the present invention to provide a truck having the characteristics sought, which has a simplified and efficient configuration.

These and other objects of the present invention will become apparent in view of the present specification, claims and drawings.

SUMMARY OF THE INVENTION

The present invention is a truck apparatus for railroad cars. At least two of the axles for the truck apparatus are configured to be able to move so as to go radial, relative to the center of curvature, when the railroad car travels through a curve. A prompting apparatus provides that the axles go radial in such a way that the movements of the axles are symmetrical with respect to each other, and with respect to an imaginary centerline extending from one side of the truck to the other side.

In addition, the prompting apparatus is configured so that the amount of movement of the axles is linear, throughout the range of movement of the axles and in direct proportion to the amount of increasing curvature.

Damping apparatus are also provided which cooperate with the prompting apparatus, to ensure that the axles of the wheel sets will undergo radial movement substantially only during curves, so as to reduce hunting and oscillatory movements when the railroad car is in straight line travel.

The present invention also includes an improved axle bearing construction which is configured to accommodate pivoting of the axles throughout a full range of angular movements.

In addition, the present invention also includes an improved side frame construction, which permits substantially independent support for each of the axle ends, for equalization of the loading to all of the wheels of the truck.

In a preferred embodiment of the invention, wherein at least one of the axle bearing support members is operably configured to pivot, in a plane extending substantially horizontally, during said driven movement of said axle bearing support member, the steerable truck apparatus further comprises guide means, operably associated with the at least one axle bearing support member and the bolster member, for operably constraining the movement of the at least one axle bearing support member to a substantially predetermined arc of movement.

The guide means preferably comprise at least one lateral strut member operably connecting the bolster member and the at least one axle bearing support member, the at least one lateral strut member further having a first end and a second end; a pocket operably disposed on the bolster member, operably configured for receiving one of the first and second ends, the pocket further being operably configured for accommodating precessional movement of the at least one lateral strut member, relative to the bolster member; and a pocket operably disposed on the at least one axle bearing support member, operably configured for receiving the other of the first and second ends, the pocket further being operably configured for accommodating precessional movement of the at least one lateral strut member, relative to the at least one axle bearing support member.

The first and second ends of the lateral strut members have substantially spherical configurations, and the pockets on the bolster and the at least one axle bearing support member each include at least one substantially concave shoe member for receiving at least a portion of one of the first and second ends of the lateral strut members.

In a preferred embodiment of the invention, at least one of the pinion members has first and second ends, and a circumferential surface extending around a longitudinal axis, with at least one set of first gear teeth disposed on the circumferential surface at a position substantially midway between the first and second ends, for engaging the at least one idler gear member, and at least one set of second gear teeth positioned substantially adjacent at least one of the first and second ends of the pinion member, at a position angularly removed about the circumference from the at least one set of first gear teeth, for engaging the pinion rack member; and the at least one idler gear member has a circumferential surface, and first set of gear teeth, for engaging the idler rack member, and a second set of gear teeth operably disposed at a position angularly removed about the circumference from the first set of gear teeth, for engaging the pinion member.

DETAILED DESCRIPTION OF THE INVENTION

Figure 1:
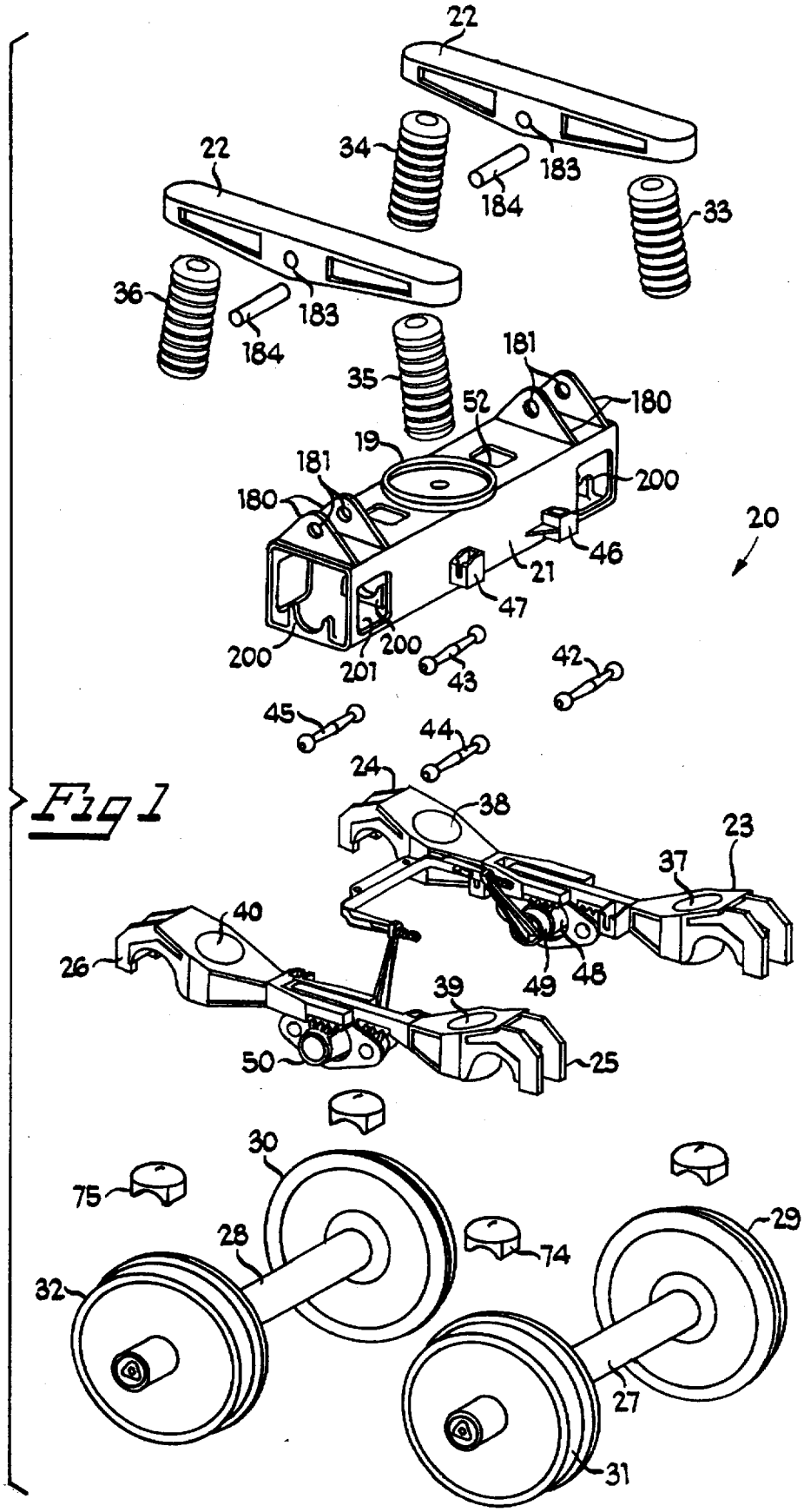
FIG. 1 is an exploded top perspective view of the linear steering truck apparatus according to the present invention.

While this invention is susceptible of embodiment in many different forms, there are shown in the drawings and will be described in detail herein, several preferred embodiments, with like parts designated by like reference numerals and with the understanding that the present disclosure is to be considered as an exemplification of the principles of the invention, and is not intended to limit the invention to the embodiments illustrated.

FIG. 1 is an exploded perspective view of a linear steering truck 20 according to a preferred embodiment of the invention. Truck 20 includes bolster 21 and two side frames 22. Bolster 21 is preferably configured in the general shape of a hollow rectangular box, and is provided with gudgeons 180, which are set in pairs at opposite ends of bolster 21. The gudgeons 180 of each pair are spaced apart a distance slightly greater than the width of a side frame 22, so that a side frame 22 can be received between each pair. Gudgeons 180 are provided with apertures 181, which align with apertures 183 in side frames 22, when side frames 22 are received between respective pairs. Pinties 184 are insertably received in respective aligned apertures 181, 183, so as to mount side frames 22 in supported, pivotable relation to bolster 21.

Pedestals 23, 24 and 25, 26, rest on axles 27, 28, upon which wheels 29, 30, 31 and 32 are fixed. Springs 33, 34, 35 and 36 rest in seats 37, 38, 39 and 40, in pedestals 23–26, respectively, and support side frames 22. Truck 20 is preferably suitably configured so as to be connected to a carbody (not shown) by any suitable means, such as a conventional post (not shown) and bowl 19 combination, such as are known in the art.

Figure 14:
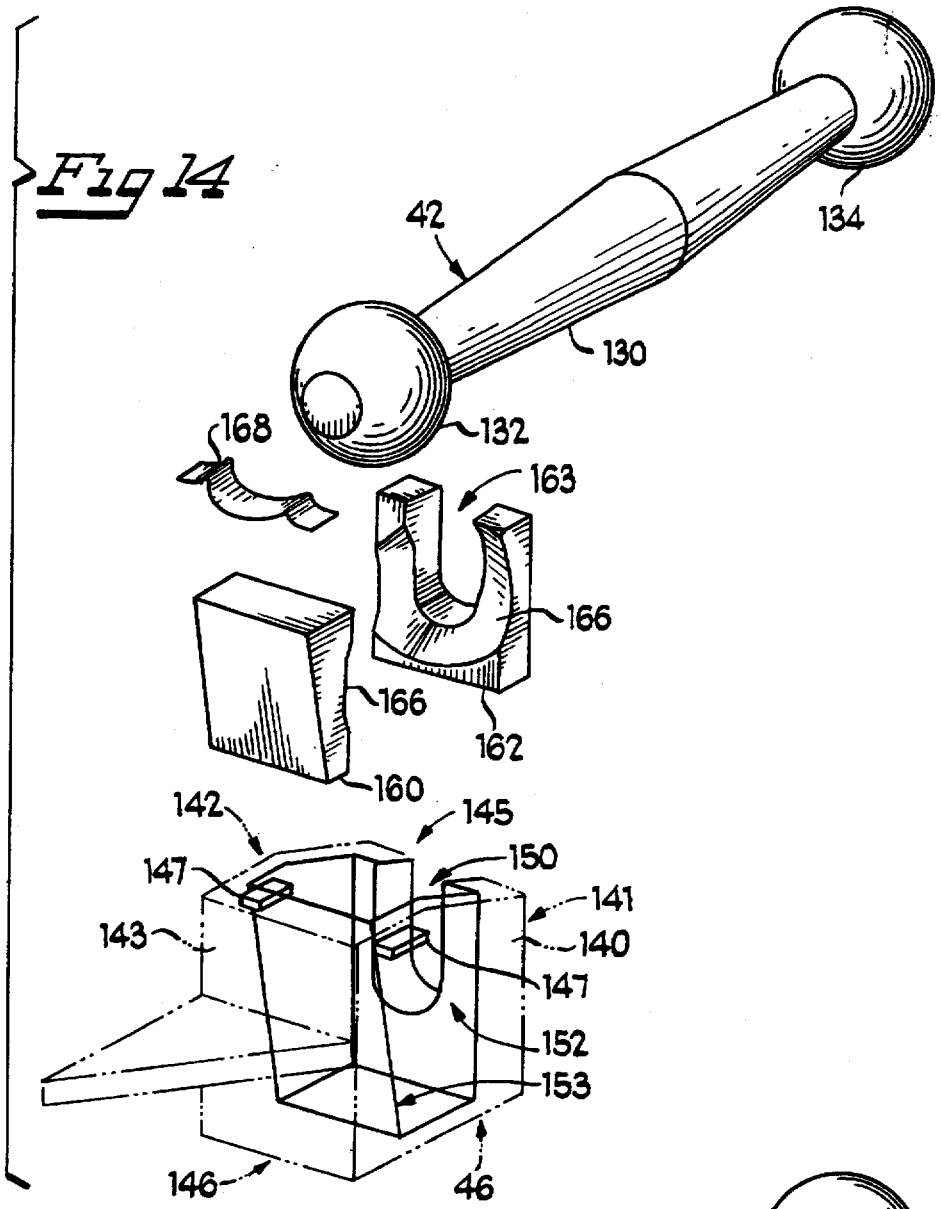
FIG. 14 is an exploded, enlarged perspective view of a lateral strut.
Figure 15:
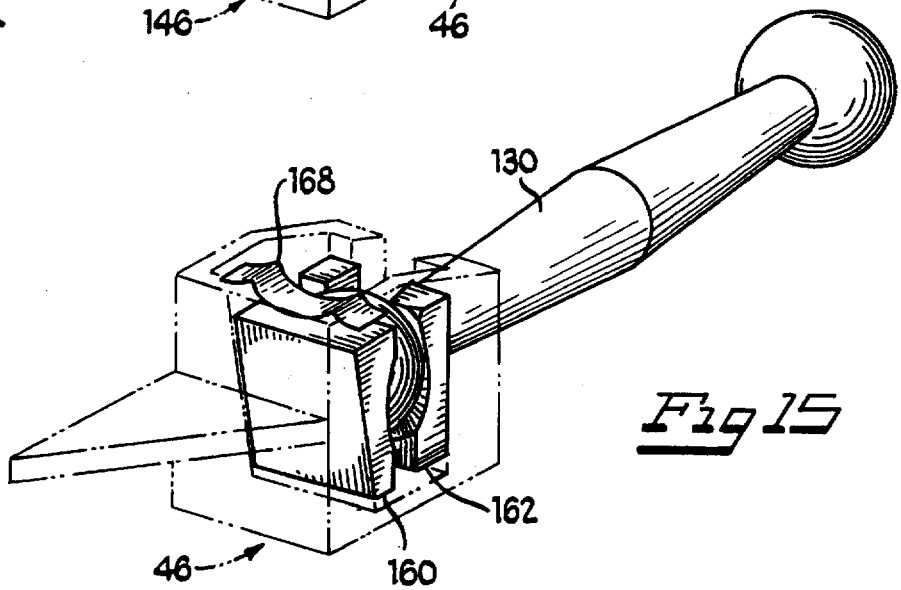
FIG. 15 is an enlarged perspective view of a lateral strut.

Lateral struts 42, 43, 44 and 45 are pivotably connected at their outer ends to pedestals 23–26, respectively, and are pivotably connected at their inner ends to bolster 21, by suitably configured pockets, such as pockets 46, 47. See also FIGS. 14 and 15, for enlarged, detailed views of a representative lateral strut. The lateral struts 42–45 transmit lateral forces between the pedestals and the bolster. Loads on the steering components are thereby reduced.

Each lateral strut, such as strut 42 (FIGS. 14, 15), is configured as an elongated body 130, having spherical end members 132, 134 at opposite ends thereof. One end (e.g., end member 132) of each strut is received in a pocket, such as pocket 46 (as also seen in FIG. 1). Four pockets are located on the bolster, and one pocket (190, 191, 192, 193) is situated on each pedestal (23, 24, 25, 26), respectively.

Each pocket may be configured to be generally rectangular, with four side walls 140–143, and with an open top 145 and bottom wall 146. Each pocket has a slotted side wall, such as side wall 141, with an upwardly opening slot 150. The inner faces 152, 153 of slotted side wall 141 and opposing side wall 143, respectively, are formed with a small included angle between them, so that faces 152, 153 are farther apart at top 145 than at bottom 146. In the other two side walls, notches 147 are provided on the inner faces.

In order to facilitate receipt of a spherical end member 132 within a pocket, two shoe members 160, 162 are provided for each pocket. Each pocket will be provided with a taper shoe 160, and a split shoe 162, having an upwardly opening slot 163. Each of shoes 160, 162 will have a spherical depression 166 on one, inner, side, for receiving the spherical end member. The opposite side of each shoe member will be planar, to smoothly engage the respective inside face of the respective side wall.

The taper shoe 160 will preferably be configured to fit between the inner face of the side wall 143 opposite the split side wall 141 of the pocket and the spherical end member of the strut, for carrying compressive loads from the strut. In a preferred embodiment of the invention, the outer face and the inner face (excluding the spherical depression) of taper shoe 160 will not be parallel, but instead will have an included angle between them of less than 7°. The outer face and the inner face (excluding the spherical depression) of split shoe 162 will be parallel, preferably. The split shoe 162 will preferably be configured to fit between the inner face of the split side wall 141 of the pocket and the spherical end member of the strut, and receive and surround a portion of the elongated body of the strut and the inner surface of the spherical end member, for absorbing tensile loads exerted along the strut. In a preferred embodiment of the invention, the shoe members will be fabricated from materials such as forged or cast steel or iron. Preferably, the inner faces of the shoes, at least, will have smoothed, locally hardened surfaces, for enhanced durability and low friction characteristics.

By having the inner faces of side walls 141, 143 describe an upwardly opening included angle, the shoes are forced into close fit around the spherical end member of the strut. An adjusting spring 168, the ends of which are configured to be received in notches 147, is configured to exert a downwardly-directed force against the taper shoe 160. Spring 168 will, however, permit limited vertical movement of taper shoe 160, in response to vertical loads being transmitted through the strut in response to movement of the respective pedestal to which it is attached. Since the taper shoe is itself wedge-shaped, with its thickest portion at the top, spring 168 will cooperate with the taper shoe to keep the assembly of the spherical end member, and the shoes in place within the pocket, thus keeping each strut in place, during movement of a truck 20. Split shoe 160, being essentially planar, will be permitted by its configuration, to closely "follow" spherical end member 132 of the strut, and taper shoe 160, as they undergo the limited vertical movement previously described.

The length of the struts and the positioning of the pockets on the bolster and the pedestals will be selected, relative to the dimensions of the other components of truck 20, according to conventional design techniques, so that the motion of the outboard ends of each strut will align its respective pedestal to closely follow the motion of the axle journals, through their ranges of lateral and vertical motion. As can be readily comprehended, in the absence of the lateral struts, the axle bearing ends of the respective pedestals would otherwise tend to be moved laterally as a result of forces exerted on the axle bearings from the axles, the force in turn being exerted by the wheels onto the axles, as the truck moves along the track. The lateral struts will act as guide members to constrain the movement of the axle bearings, and, in turn, the pedestals themselves, to movement along generally predetermined arcs, and the lateral struts will absorb and redirect at least a portion of the compressive and tensile forces which would otherwise be borne by the axle bearings. Thus, compressive and tensile forces on the axle bearings will be greatly reduced, and bearing life will be increased, as such forces will instead be partially borne by the struts, the shoes and the pocket structures.

Two torque members, such as torque member 48 (which may be in the form of a generally cylindrical tube), are suitably mounted beneath bolster 21, for free rotation about an axis parallel to but beneath bolster 21. For example, each torque member 48 may be supported, such as by bearings 49, 50, within U-shaped support members 200, which are provided within the interior of bolster 21. Preferably, two spaced apart support members 200 are provided at each end of bolster 21, extending upwardly from the bottom interior wall 201 of bolster 21. Fixedly attached to each torque member 48 is a steering arm 91, which is connected, by a mechanism described hereinafter, to the carbody.

An improved stiffening apparatus 90 has been provided, for reducing "hunting" as illustrated in FIGS. 10–13. At the free ends of steering arms 91 are apertures 92, which have beveled interior contours 93. Carbody attachment 170 is provided, which preferably is fixedly attached to the carbody with fasteners, such as bolts, through holes 171. Longitudinal members 95 and lateral member 96 describe a "U" shape, connecting from one steering arm 91 longitudinally along the carbody, and then laterally across the centerline of the car and then longitudinally to the steering arm 91 on the opposite side of the truck.

Carbody attachment 170 connects steering arms 91. The joint created at the connection allows each steering arm 91 to rotate, move laterally and vertically and rotate freely, while holding its longitudinal position rigidly. The joints are constructed with spring-loaded members to create damping of any periodic motion which might otherwise tend to occur.

In a preferred embodiment of the invention, the cross-section of carbody attachment 170 changes along its length. Longitudinal members 95 preferably are channels, to increase stiffness and prevent buckling. Lateral member 96 preferably is L-shaped in cross-section, for stiffness and easy attachment to the carbody. The two right-angle bends 172 between the longitudinal and lateral members are a single web, to allow adequate lateral and vertical of the longitudinal members 95 at the connections to the steering arms 91. The relatively low stiffness of the webs in the bends 172 leads to a reduction in stress, increasing the fatigue life of the attachment member 170.

Figures 10, 11, 12, 13:
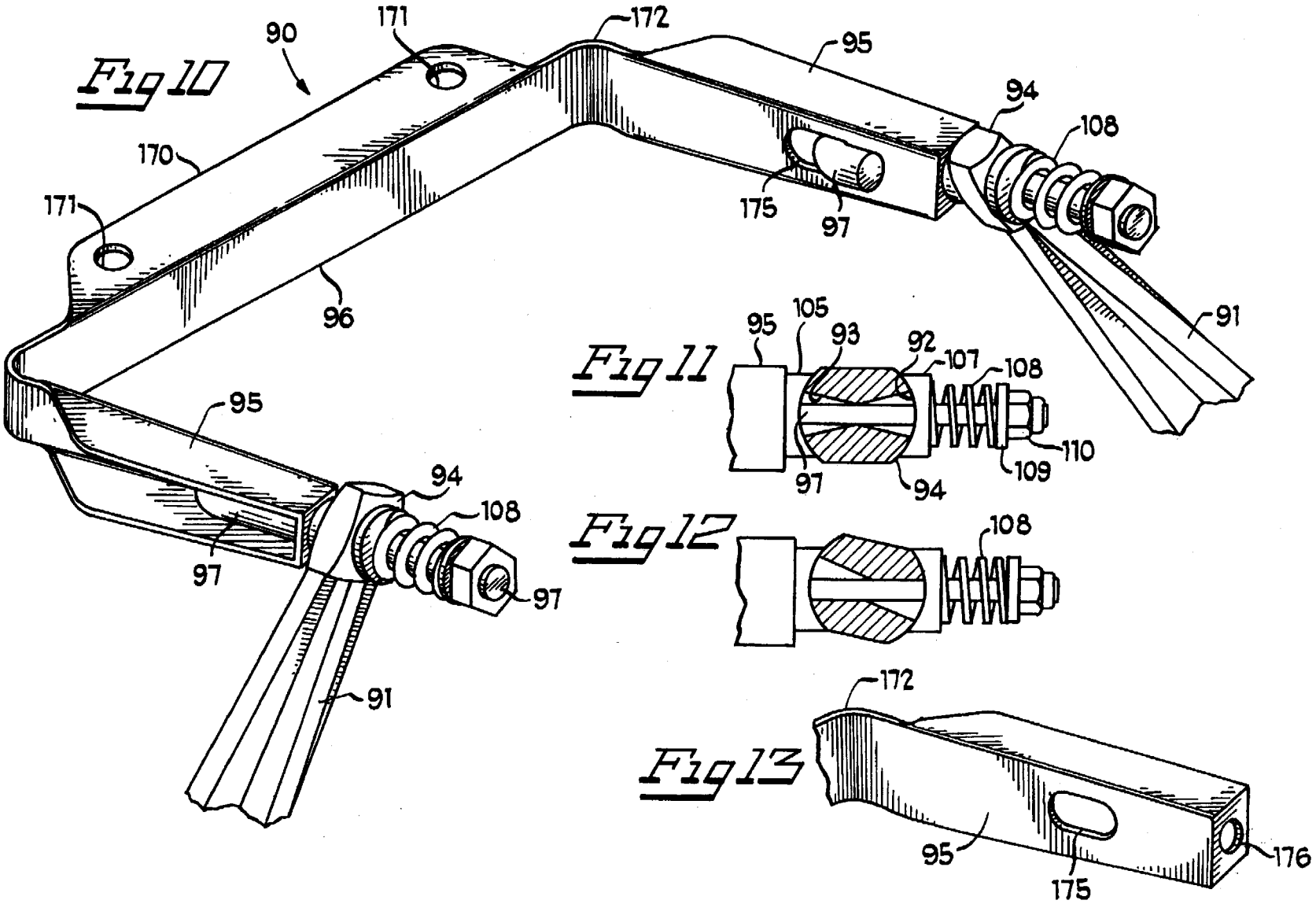
FIG. 10 is a perspective view of a portion of the prompting apparatus, according to a preferred embodiment of the invention.
FIG. 11 is a sectional view of a portion of the stiffness apparatus of FIG. 10, taken along line 11—11 of FIG. 10.
FIG. 12 is a sectional view of the stiffness apparatus of FIG. 11, during steering, taken along line 12—12 of FIG. 10.
FIG. 13 is a fragmentary view of a component of FIG. 12 showing it unassembled.

Steering arm spherical ends 94 engage spherical sockets 105, 107. A high rate spring 108 loads the sockets against steering arms 91, creating an energy absorbing joint. The inner surfaces of sockets 105, 107, and the outer faces of spherical ends 94 are substantially congruently spherical, and have the same radius of curvature. Accordingly, spring 108, pressing against socket 107, creates a substantial friction force between the inner, concave face of socket 107 and spherical end 94, and between the inner, concave face of socket 105 and the other "side" of spherical end 94. During a steering action, as illustrated in FIG. 12, the axial spacing, along J-bolt 97, between socket 105 and socket 107 does not change, and there is no force exerted by the elements which would tend to cause spherical end 94 to return to the neutral, non-steering position illustrated in FIG. 11. Accordingly, the stiffness mechanism of FIGS. 10–13 has "neutral equilibrium", tending to remain in whatever position it is left in, until altered by forces being transmitted up lever arms 91 from the pinion and idler gear mechanism.

In an alternative embodiment (not shown), the inner surfaces of the sockets and the outer faces of the spherical ends could be provided with non-spherical (i.e., non-circular in cross-section) mating surfaces, but rather could be provided with elliptical or parabolic, so that when the spherical ends are rotated from their non-steering positions, the sockets would be pushed apart, against the force exerted by the springs. When the steering movement is concluded, and the spherical ends return to their neutral positions, as a result of the movement of the lever arms 91 back to their original, non-steering positions, the sockets would be assisted in their axial movement closer to one another by the exertion of force by the springs.

In either embodiment, the joints between longitudinal members 95 of carbody attachment 170 and steering arms 91 would be formed, in part, by J-bolts 97. J-bolts 97 engage longitudinal members 95, at slots 175 and apertures 176, pass through corresponding apertures in sockets 105, steering arm apertures 93, sockets 107, loading springs 108, washers 109 and locking nuts 110.

When a railroad car having a truck 20 with one of the foregoing mechanisms is travelling along straight track, the springs 108 will act to hold steering arms 91 in their upright (neutral) positions, thus preventing the prompting mechanisms from spontaneously moving the axles to alternating "radial" positions. In addition, apparatus 90 will help to prevent pivoting of truck 20 generally, relative to the car body, to help prevent the sinusoidal tracking movements which the truck would otherwise undergo, as a result of the lateral hunting of the wheel sets caused by the conicity of the wheel contours.

When a curve is encountered, the rotation of the car body relative to the truck will cause alternate pushing and pulling forces on the members 95 (which are positioned to opposite sides of the truck center line). At the other end of each longitudinal member 95, under the combined forces being transmitted through the wheels, axles, racks and gearing, and from the pushing and pulling of the rods, steering arms 91 will pivot from their neutral positions (FIG. 11). In FIG. 12, for example, longitudinal member 95 is being pulled from a neutral position. The torque exerted upon steering arms 91 from longitudinal member 95 and torque member 48 causes arm 91 to pivot, in turn, causing torque member(s) 48 to rotate, permitting the radial movement of the axles. The beveled contour 93 of aperture 92 permits arm 91 to move from a position perpendicular to longitudinal member 95. As the railroad car exits the curve, the spring force will tend to return the prompting mechanism to its neutral configuration, by pushing sockets 105, 107 against spherical ends 94, and tending to cause spherical ends 94 to rotate back to their neutral positions, thus tending to push steering arms 91 back to their upright positions, and tending to keep them in their upright positions.

An alternative stiffness adding mechanism is illustrated in FIGS. 10A–12A, in which elements having like configurations and functions have been given the same reference numerals as in FIGS. 10–13. As illustrated in FIGS. 10A–12A, rods 95 are mounted on a crossbar 96, which is fixedly attached to the car body (not shown). Each rod 95 is slidably affixed to cross-bar 96, passing through an aperture 97. Springs 98, 99 are contained between cross-bar 96, and nut 100 and flange 101 (both fixed with respect to rod 95), and resiliently position each rod 95 relative to cross-bar 96.

Figure 11A:
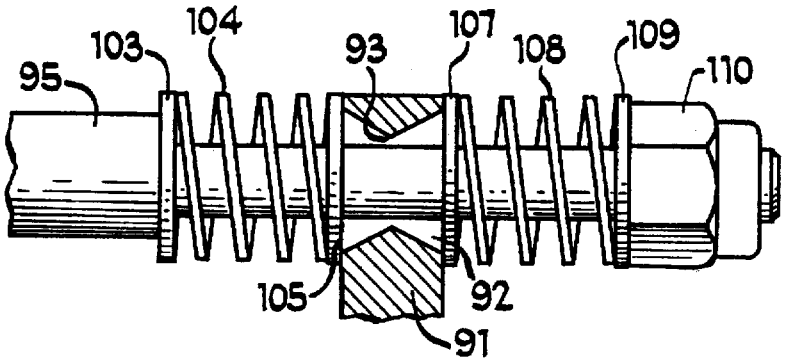
FIG. 11A is a sectional view of a portion of the stiffness apparatus of FIG. 10A, taken along line 11A—11A of FIG. 10A.
Figure 12A:
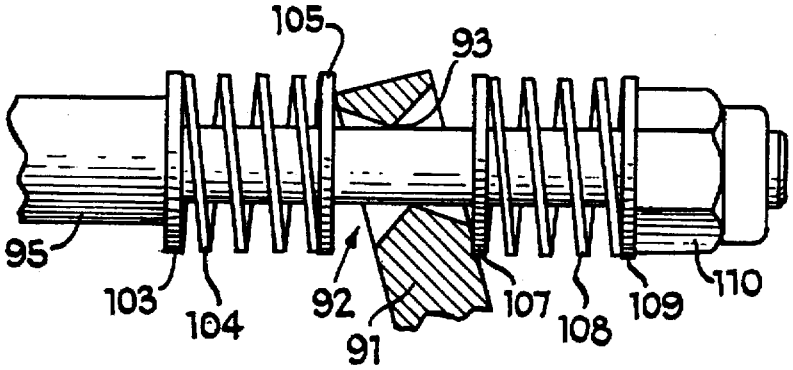
FIG. 12A is a sectional view of the stiffness apparatus of FIG. 11A, during steering, taken along line 12A—12A of FIG. 10A.

The foregoing structure may be provided in addition to the following structure. At the opposite end of each rod 95, an annular plate 103, a spring 104, and another annular plate 105 may be mounted, all of which are positioned between crossbar 96 and the upper end of one of arms 91. Between the upper end of the arm 91 and the end of the respective rod 95 are another annular plate 107, another spring 108, plate 109 and nut 110. All of spring 98, 99 and 104, 108, when in the neutral positions illustrated in FIGS. 11A and 12A are in a partially compressed state.

When a railroad car having a truck 20 with the foregoing mechanism is travelling along straight track, the springs 104, 108, and 98, 99 (if provided), will act to hold arms 91 in their upright (neural) positions, thus preventing the prompting mechanisms from spontaneously moving the axles to alternating "radial" positions. In addition, apparatus 90 will help to prevent pivoting of truck 20 generally, relative to the car body, to help prevent the sinusoidal tracking movements which the truck would otherwise undergo, as a result of the lateral hunting of the wheel sets caused by the conicity of the wheel contours. When a curve is encountered, the rotation of the car body relative to the truck will cause alternate pushing and pulling forces on the rods 95 (which are positioned to opposite sides of the truck center post (not shown). If the springs 98, 99 are not provided, the pushing and pulling forces will be immediately acting.

Figure 16:
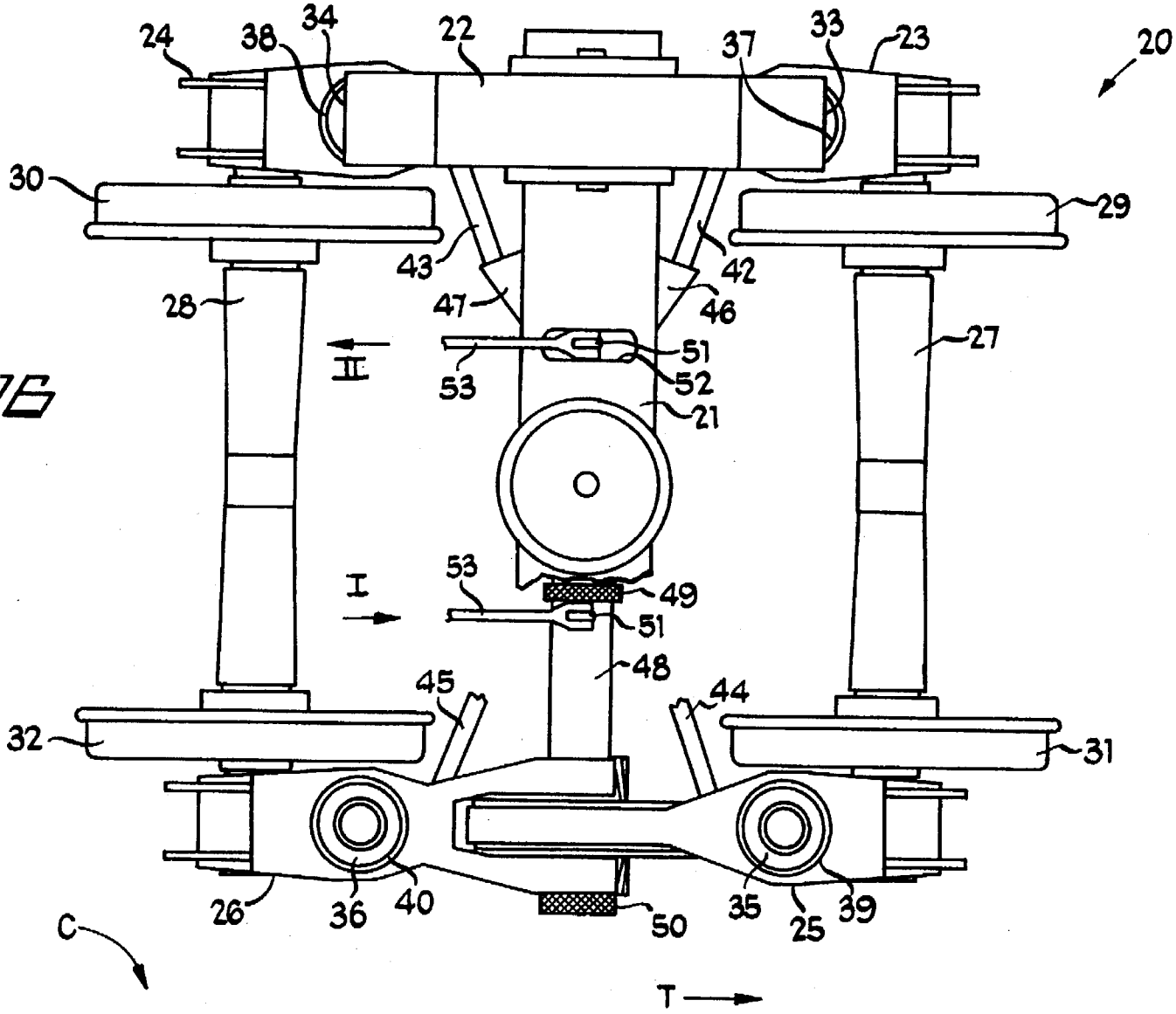
FIG. 16 is a top plan view of an alternative embodiment of the truck apparatus, with a portion of the bolster cut away to illustrate the torque member beneath.

Instead of the stiffness adding mechanism of FIGS. 1, 10–13, or FIGS. 10A–12A, steering arm 91 could be replaced, in an alternative embodiment of the invention, by a simple crank 51 (FIG. 16), which might be attached, such as by a simple pivot, or a U-joint, to linkage arms 53, which would be attached at their remote ends, to the carbody. Cranks 51, which, when the truck 20 is in a straight line travel configuration, would likewise extend straight upward, through elongated apertures 52 in bolster 21. While the crank and linkage arm configuration of FIG. 16 would not provide the damping which mechanism 90 provides, the other steering functions of truck 20 would not be otherwise be affected. In FIG. 16, the struts 42–45 and pockets 46, 47 for receiving the ends of the struts 42, 43 are illustrated schematically, the details of same being illustrated and described in further detail with respect to FIGS. 14 and 15.

Figure 2:
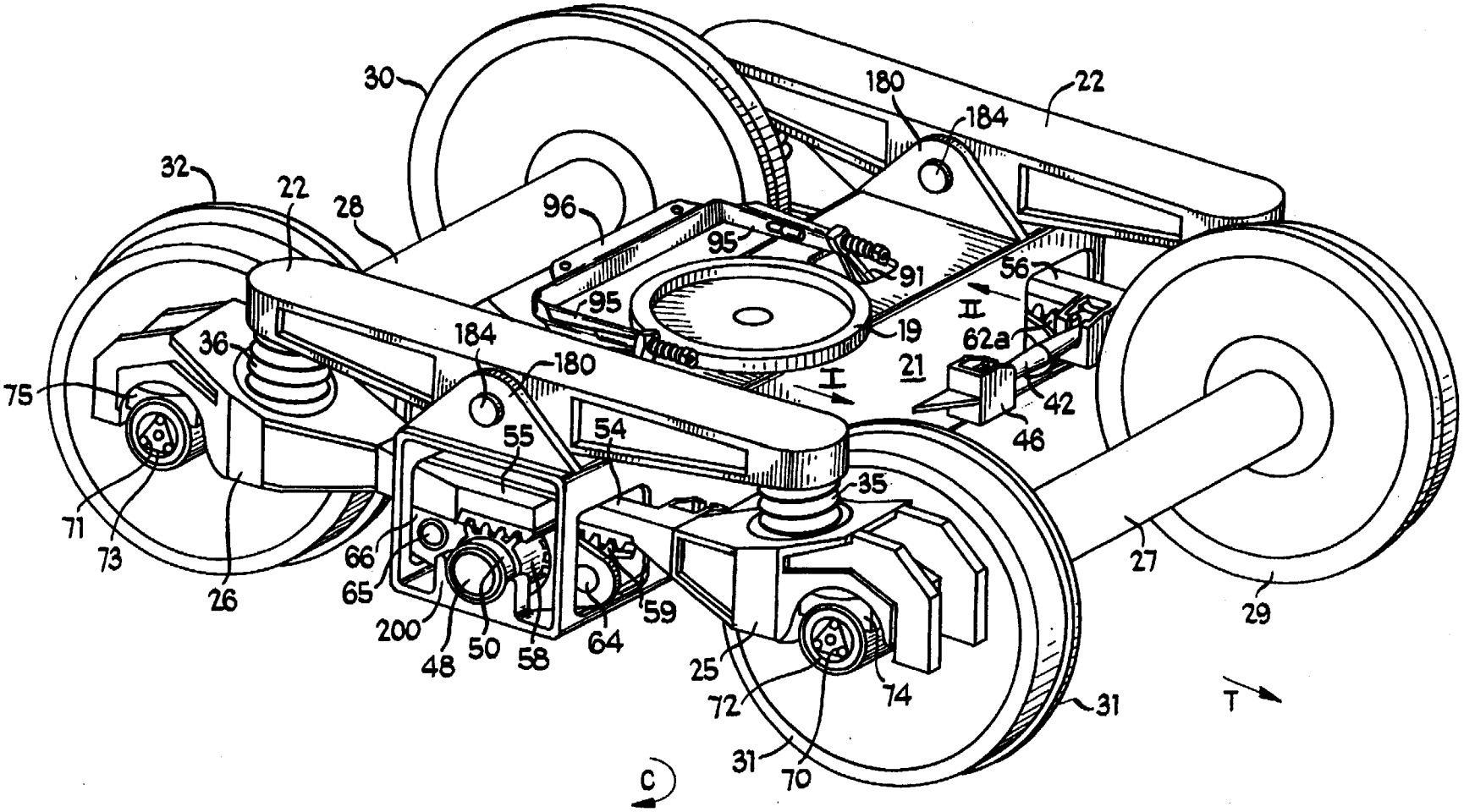
FIG. 2 is a top, perspective view of the linear steering truck apparatus according to FIG. 1.

The interrelation of the pedestals, axles and side frames is illustrated in FIG. 2. The side of truck 20 not seen in FIG. 2 is arranged substantially as a mirror image of the side shown in FIG. 2. Rack portion 54 of pedestal 25 rests upon segmented idler gear 59, on one side of pinion 58 and another segmented idler gear (not shown) that is disposed on the other side of pinion 58. Rack portions 55 of bifurcated pedestal 26 rests upon pinion 58, which is affixed adjacent the outer end of a torque member 48. The idler gears are supported for rotation by shafts 64, 65, which are integral with the idler gear and are mounted in bracket 66. Bracket 66 is held in place by the idlers interlocking with racks 54 and 55 and pinion 58, so that the weight of the idler gears, and bracket 66, as well as any downward vertical loading on same, is transmitted through torque member 48, through support members 200 and into bolster 21. Bottom wall 201 of bolster 21 extends the width of truck 20, and is part of bolster 21. As previously stated, side frames 22 are pivotably mounted to bolster 21 via gudgeons 180 and pinties 184.

Figures 4A, 4B:
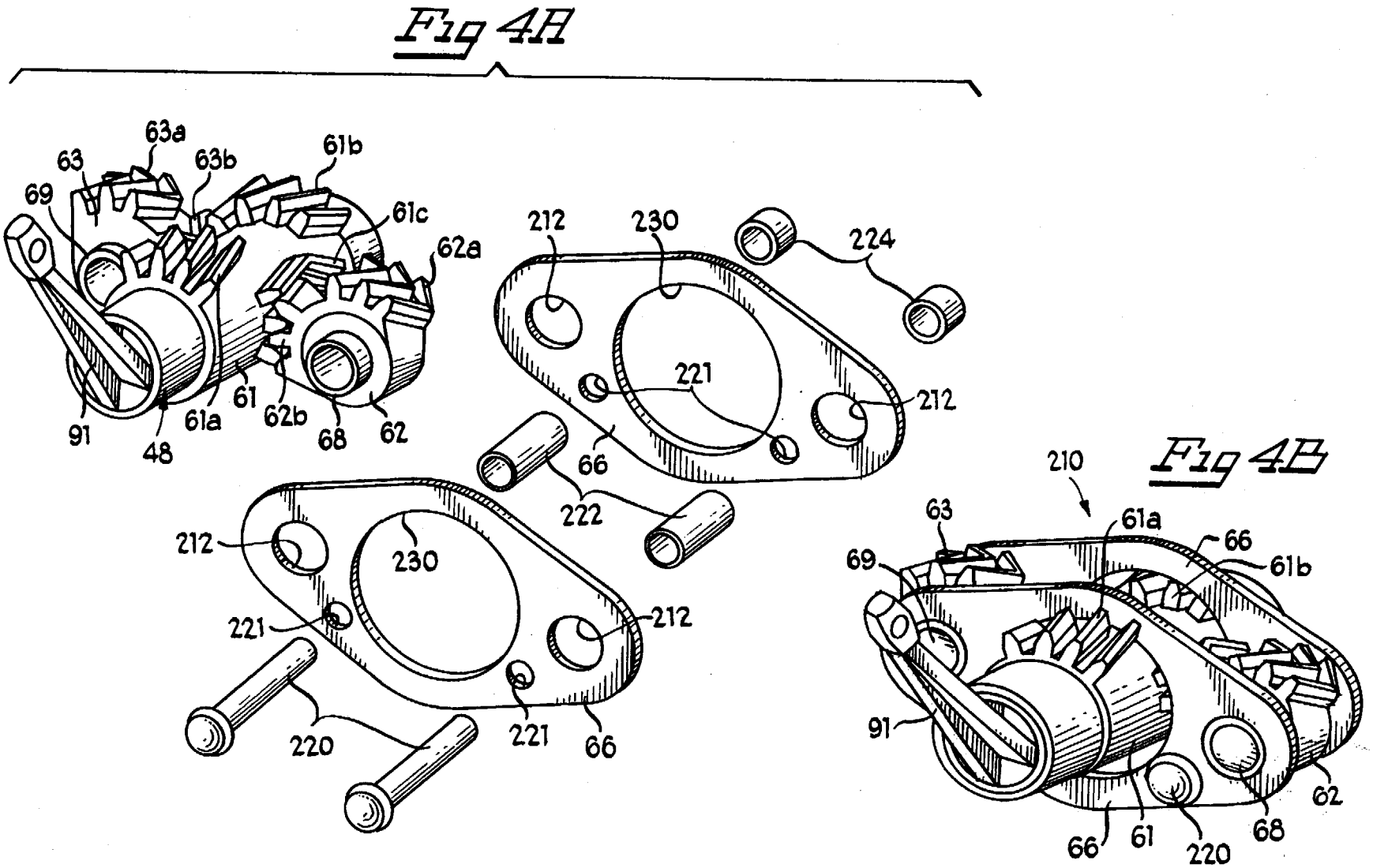
FIG. 4A is an exploded perspective view of the bracket, idler and pinion, torque member and steering arm, for the steering mechanism for the truck apparatus of the present invention, according to a preferred embodiment of the invention.
FIG. 4B is an assembled perspective view of the components illustrated in FIG. A.
Figure 4C:
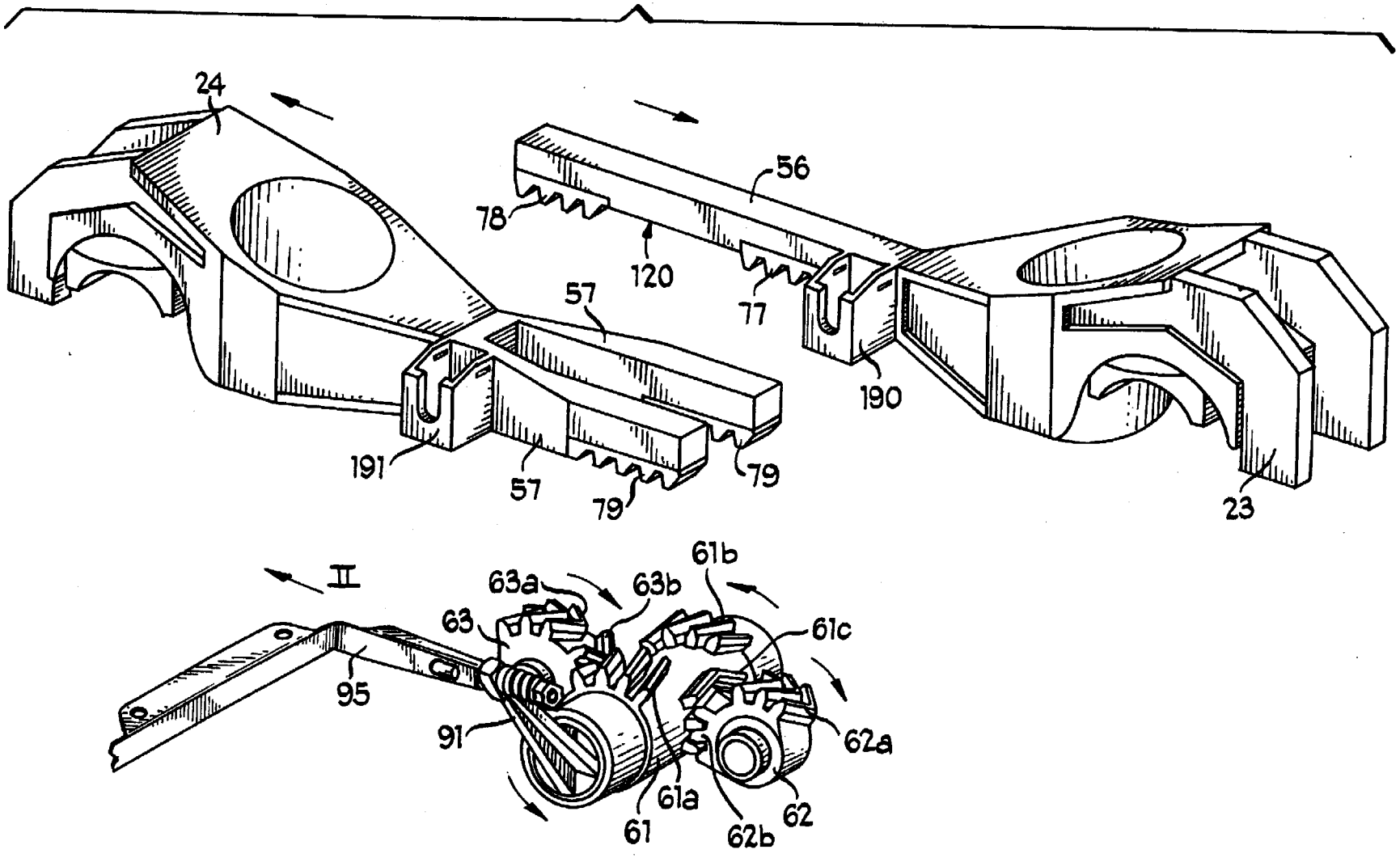
FIG. 4C is a partly exploded perspective view of the rack members, the pinion and idlers, for one side of the truck apparatus of the present invention, according to a preferred embodiment of the invention.

FIGS. 4A, 4B and 4C illustrate the assembly and cooperation of the pinions and idlers of the steering mechanism. Gear set 210 (FIG. 4B), for one side of a truck 20, comprises segmented idler gears 62, 63 and segmented pinion 61. Pinion 61 has axially spaced apart toothed segments 61A and 61B plus a pair of opposed toothed segments 61C and one (not shown) diametrically opposite to 61C. Toothed segments 61C and the one opposite it are radially offset from toothed segments 61A and 61B. Idler gear 62 has toothed segments 62A and 62B which are radially spaced apart. Idler gear 63 has similarly disposed toothed segments 63A and 63B. Brackets 66 receive, in apertures 21 2, the ends of shafts 68, 69 of the idlers. Brackets 66 are held together, to surround the idlers and the pinion, by bolts 220, spacers 222 and nuts 224. Assembly is accomplished in a readily discernible manner. The idlers are received by their shafts in one of brackets 66. Pinion 61 is in place between the idlers.

The large diameter apertures 230 in each of brackets 66 are large enough in size to clear even the toothed segments 61A, 61B, 61C and the one (not shown) that is diametrically opposite 61C of pinion 61, through the simple expedient of passing pinion 61 through apertures 230 (or rather passing brackets 66 over pinion 61) in an off-center orientation, then realigning the components, once the toothed segments of pinion 61 have been cleared. Then the other bracket 66 is fitted over the opposite ends of the shafts, and over pinion 61 in a similar manner. With the components aligned, toothed segment 62B of idler 62 is in engagement with segment 61C of pinion 61 and toothed segment 63B of idler 63 is in engagement with the toothed segment of pinion 61 opposite 61C. As a result of the engagement of the toothed segments and, the bolted assembly of brackets 66, idlers 62 and 63 are maintained symmetrically disposed with respect to pinion 61 about the generally vertical diameter of pinion 61. Bolts 220 are then inserted into apertures 221, and through spacers 222 which have been positioned between brackets 66 and aligned with apertures 221. After the ends of bolts 220 have passed through the apertures 221 in the opposite bracket 66, nuts 224 are affixed to hold the bolts in place and hold gear set 210 together with pinion 61 maintained in a centered position by its toothed segments' 61C and the one opposite it engagement with the toothed segments of 62B and 63B of idlers 62 and 63, respectively.

The ends of axles 27, 28 may be conventionally connected to roller bearings 70, 71, which, in turn, are rotatably fitted within cylindrical bearings 72, 73 respectively. Bearing adapters 74, 75 (shown and discussed in further detail with respect to FIG. 7) rest atop and hold cylindrical bearings 72, 73, respectively.

Accordingly, the loading on the truck, with respect to the side illustrated in FIG. 2, is as follows. Some portion of the weight of the car body (including lading and the car body itself), which may be more or less than half, depending upon distribution, passes through the central post on the carbody into bowl 19 and into bolster 21. From bolster 21, the load is divided equally through side frames 22, such that half the load proceeds through springs 35, 36, and the other half through springs 33, 34. Discussing now the loading for one side of the truck 20 and referring to FIG. 2 (the loading being presumed to be symmetrical in static conditions), from spring 35, a portion of the load passes through pedestal 25 onto axle 27. Since pedestal 25 rests upon idler gears 59, and the one on the other side of pinion 61, these gears also bear a portion of the load, which ensures that rack portions 54 remain in engaging contact with the idler gears. From spring 36, a fraction of the load passes through pedestal 26 onto axle 28. Since pedestal 26 is pivotably supported from pinion 58, this gear also bears a portion of the load, which ensures that rack portion 55 remains in engaging contact with pinion 58. The load path on the other side of truck 20 is identical, and truck 20 is configured to be symmetrical about the longitudinal extending axis, so that the static loading of the truck is substantially symmetrical about the longitudinal axis of the truck, and preferably remains substantially symmetrical even during movement of the truck, with the exception of transient bumps, jolts, etc.

Since the components of the truck are "stacked" with vertical loading passing through both the pinions and the idlers, this loading configuration can be employed in the final finishing and assembly of the truck. The idlers and pinions, rather than being finely ground and milled prior to assembly, as would otherwise typically be done, can be relatively roughly finished, prior to assembly. Thus, gears made, for example, by a manufacturing process such as by sintering can be in suitable condition for assembly. Once assembled, the vertical loading will force the gears to self-grind and "wear in" rapidly into a closely fitting and smoothly fitting orientation. Substantial costs in the manufacturing and finishing of the gears can thus be saved. Putting vertical loading on the gears also contributes to a substantial reduction in gear backlash and gap between the interfitting teeth, further enhancing the overall performance of the steering mechanism.

When the truck encounters vertically displaced, irregular or banked track, the pivotably supported pedestals and springs provide for the substantially independent vertical movement of each end of each axle, with respect to the respective opposite ends of the axles, and the other axles. Accordingly, when the configuration of the track forces wheel 32 and one end of one axle 28 upwardly, the combination of action by springs 35, 36 and the pivoting capability of side frame 22, ensure that the loading through the various components remains substantially uniformly divided through the two axle ends. This enables the truck 20 to encounter such vertical disturbances, without being forced into a steering mode, unlike typical prior art steerable trucks.

Figure 8:
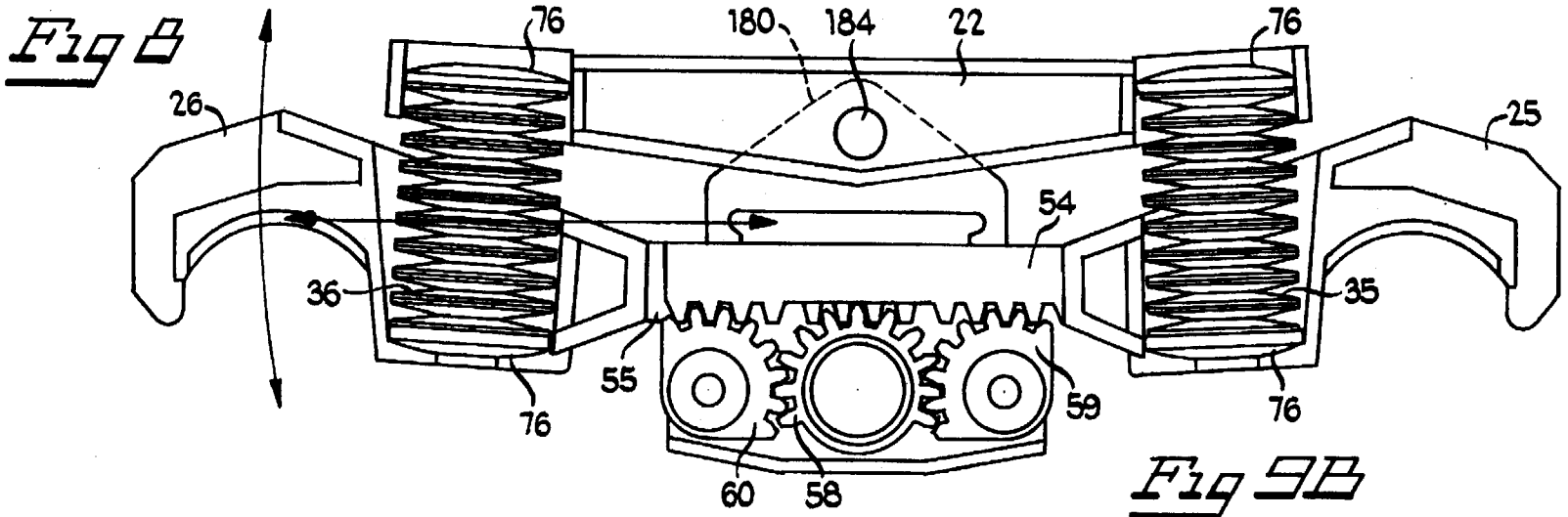
FIG. 8 is a side elevation, partly in section, showing the pedestal and side frame construction of the linear steering truck.
Figure 9B:
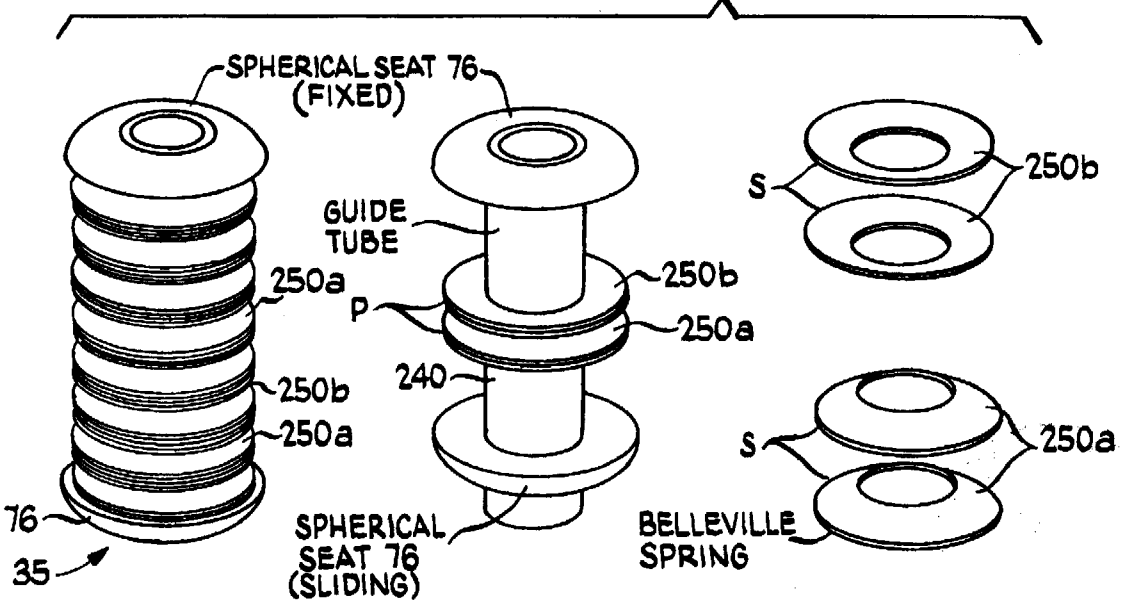
FIG. 9B shows an alternative support spring construction, both assembled and unassembled.

The springs 33–36 are not fixed at their ends to either the pedestals or the side frames. Rather, each end of each spring has a spherical cap structure 76 (see FIGS. 8, 9A and 9B), which enables each spring to pivot, so as to ensure that the ends of the spring are straight with respect to the main body of each spring, assuring direct and even loading of the springs.

It is desirable to provide a damping mechanism for the support springs, in much the same way that an automobile has shock absorbers to damp the otherwise resultant vertical oscillation that would be caused by the springs. In one preferred embodiment of the invention, a spring structure 35 is shown in which a cylindrical guide tube 240 might be provided, to connect spherical seats 76. Seats 76 would insertingly receive tube 240 and be configured so that the bottom seat 76 could move axially along tube 240 with the top seat preferably being fixed to the guide tube. Flanges or ridges (not shown) could be provided so as to prevent tube 240 from "falling out". A plurality of Belleville springs 250, grouped in several alternating opposed series 250A, 250B, would be arranged along guide tube 240, between the seats. When a vertical load would be placed on the structure, the Belleville spring series would be compressed, and provide the resilient support. At the same time, the frictional rubbing of one Belleville spring against the adjacent springs would provide frictional damping, to prevent undesired rebounding or extended oscillations. The utilization of Belleville springs provides both spring support and damping, and is a preferred construction for providing the spring support for the truck configuration of the present invention.

Figure 9A:
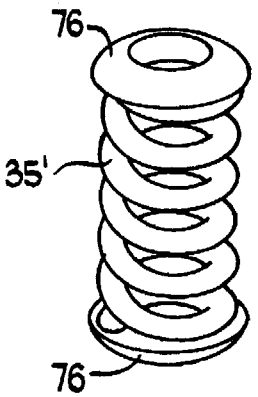
FIG. 9A is a perspective view of a support spring.
Figure 10A:
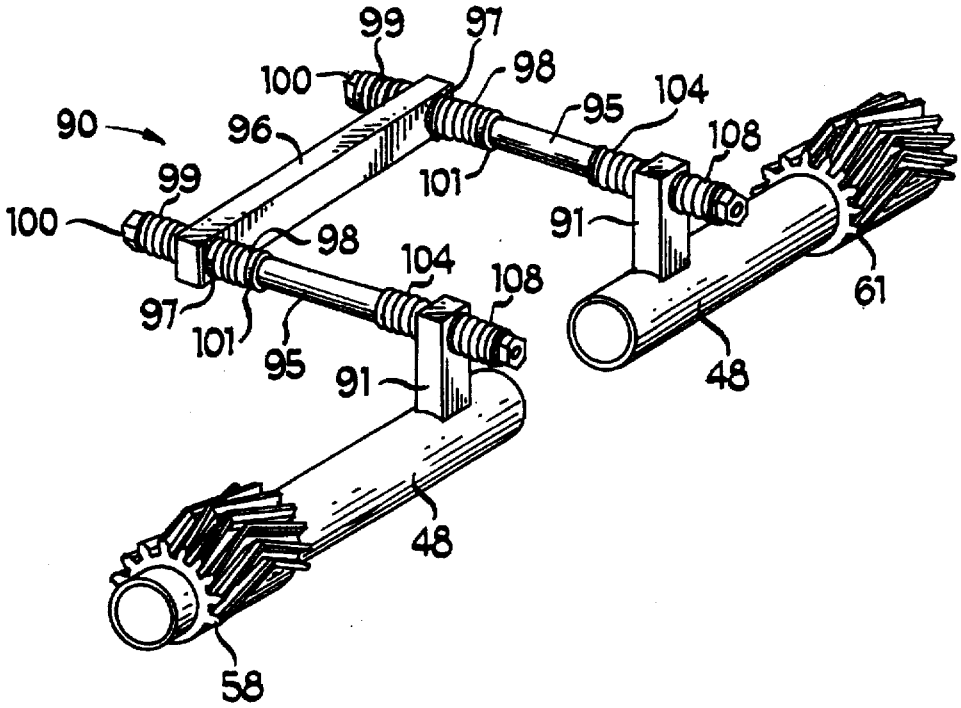
FIG. 10A is a perspective view of a portion of the prompting apparatus, according to an alternative embodiment of the invention.

In an alternative embodiment, a coil spring 35' like that illustrated in FIG. 9A may be provided, and an elastomeric or other energy absorbing structure (not shown) of a conventional type may be interdigitated between the coils of the spring. A central guide tube, for supporting such an energy absorbing structure, and to help maintain the spring "straight", may also be utilized.

Figure 3:
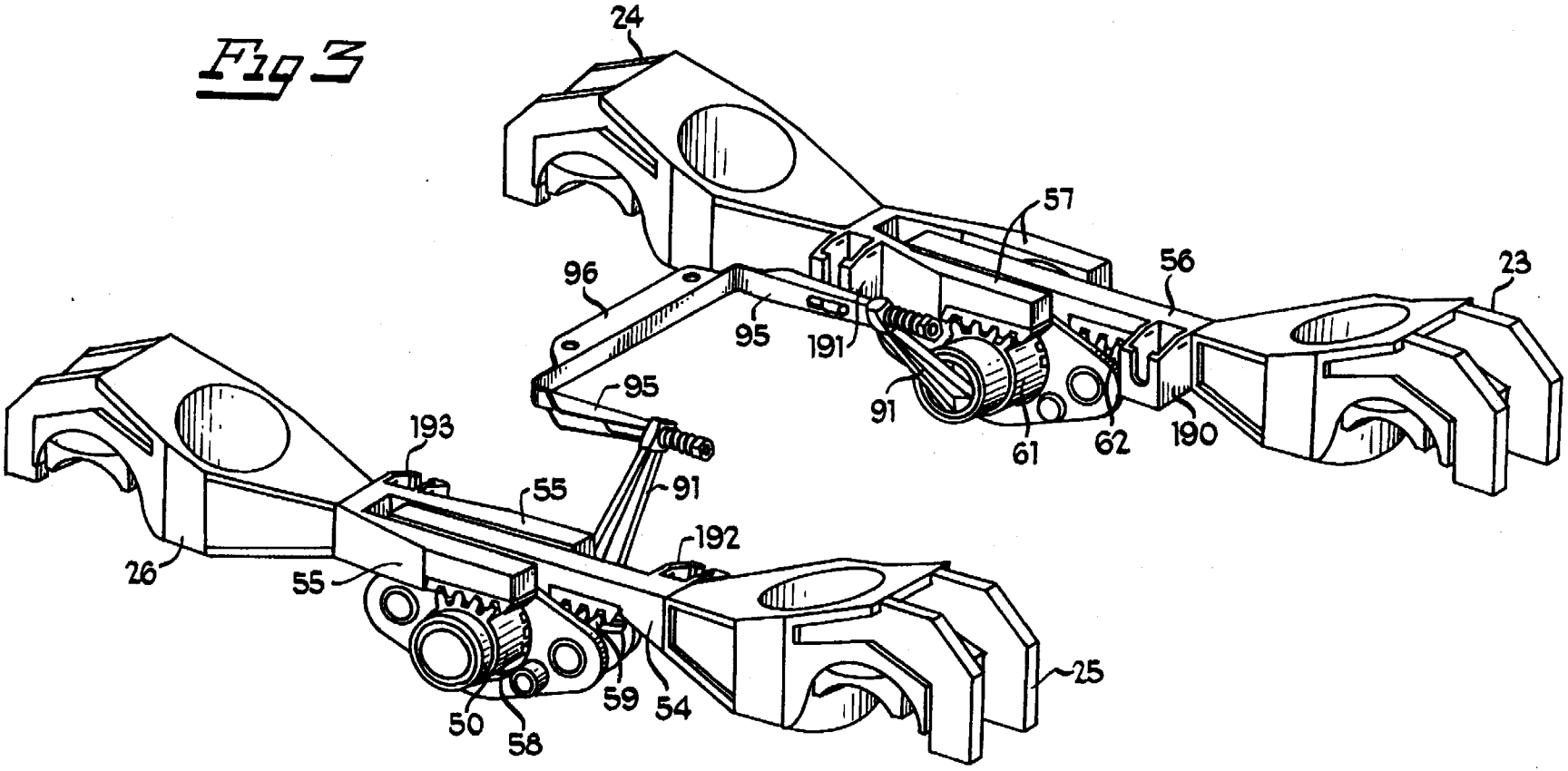
FIG. 3 is a perspective view of the prompting apparatus for the linear steering truck, according to a preferred embodiment of the invention.

The prompting mechanism for accomplishing radial movement of the axles is shown in greater detail in FIGS. 3 and 4C. Each of pinions 58, 61, has its teeth preferably formed in a crowned herringbone pattern, such that the radii of the teeth along the crown of each pinion, are greater than the radii of the teeth along the inner and outer faces of each of pinions 58, 61. Similarly, the teeth of each of the idler gears are preferably formed in a herringbone pattern. In addition, the "top" of the crown for each gear is preferably configured to describe an arc, which is concave toward the interior of the truck, to further accommodate the lateral pivoting of the pedestals which will occur during steering. The herringbone pattern helps maintain lateral stability of the pinions, idlers and racks relative to one another, and prevent lateral shifting of one gear relative to the others. Although the gear teeth are preferably in a herringbone pattern, in alternative embodiments, other gear configurations may be employed. The diameters of the idlers and pinions are preferably the same. The axial length of each of the idler gears 62, 63 is substantially smaller than the axial length of the pinion 61 such that the toothed segments of the pinion 61 extend laterally beyond each of the sides of the idler gears, and, as illustrated in FIG. 4B, actually extend laterally beyond brackets 66, preferably with no portion toothed segments 61A and 61B within or in between brackets 66. Each of the pinion and idler gears is in the form of a segmented gear, since the amount of maximum rotation required for steering will never be more than a small fraction of one revolution.

Rack portion 56 of pedestal 23 is formed as a single tine, having tooth sets 77 and 78 extending downward therefrom, with an elevated smooth portion 120 therebetween. Accordingly, when rack portion 56 is positioned on idler gears 62, 63, or more specifically on toothed segments 62A and 63A within a certain range of longitudinal movement, relative to the torque member 48, rack portion 56 does not make contact with pinion 61.

Bifurcated rack portion 57 of pedestal 24 is formed as two tines, each having a tooth set 79 which is positioned only adjacent the free end of the respective tine. Rack portion 57 is positioned on pinion 61, or more particularly on toothed segments 61A and 61B adjacent the outwardly extending portions of the pinion. Within the range of longitudinal movement of pedestal 24 with respect to torque member 48 that occurs in the present invention, rack portion 57 does not make contact with either idler gears 62, 63 or rack portion 56.

The various gears and other components of truck 20, making up the prompting mechanism for the "other side" of truck 20, as seen in FIG. 1, are arranged so as to be a mirror image of the configuration just described.

The prompting operation for prompting "radial" movement of the axles 27, 28 may now be described. Presume that a railroad car, having two such trucks 20 pivotably mounted by center posts on bowls 19, near the respective ends of the car, is proceeding along a straight run of track, and proceeds into a turn. Truck 20, illustrated in FIG. 2, will be the "front" truck of the car. The direction of travel is indicated by arrow T, the direction of the turn indicated by arrow C. The proper desired motion for each axle is to go radial, such that, with respect to truck 20, axle 28 will seek to pivot counterclockwise (relative to a plane extending parallel to the plane of the axles), while axle 27 will seek to pivot clockwise. Simultaneously, since truck 20, as a whole, will be seeking to pivot initially clockwise, relative to the car body, the lower of longitudinal members 95 will be "pushed" to the right, as seen in FIG. 2, relative to truck 20 (arrow I), while the upper of longitudinal members 95 will be pulled to the left, as seen in FIG. 2, relative to truck 20 (arrow II).

It will be readily understood, for example with respect to FIG. 4C, that if longitudinal member 95 is given a pulling force (toward the left), then torque member 48 will be forced to rotate in a counterclockwise manner, as indicated by the arrow. Pinion 61 will likewise be forced to rotate counterclockwise. Idler gears 62 and 63 will rotate in the opposite, clockwise, direction. Rack 56 and all of pedestal 23 would be urged to move forward (as indicated by the arrow), away from torque member 48, while rack 57 and all of pedestal 24 would be urged to move rearward (as indicated by the arrow), away from torque member 48. The effect of this movement would be to force the outer (with respect to the turn) ends of axles 27, 28 away from each other.

At the same time, as previously described, the lower of longitudinal members 95 (as seen in FIGS. 1 and 3), would be pushed to the right (or forwardly) relative to truck 20. The lower torque member 48 would be forced to rotate clockwise, as would pinion 58. The idler gears would rotate counterclockwise. Rack 54 and all of pedestal 25 would be urged to move to the left (rearward), while rack 55 and all of pedestal 26 would be urged to move to the right (forwardly). The total effect would be to force the inner (with respect to the turn) ends of axles 27 and 28 toward one another. The overall effect achieved is the radial movement of the axles in a coordinated and uniform manner.

Figure 5:
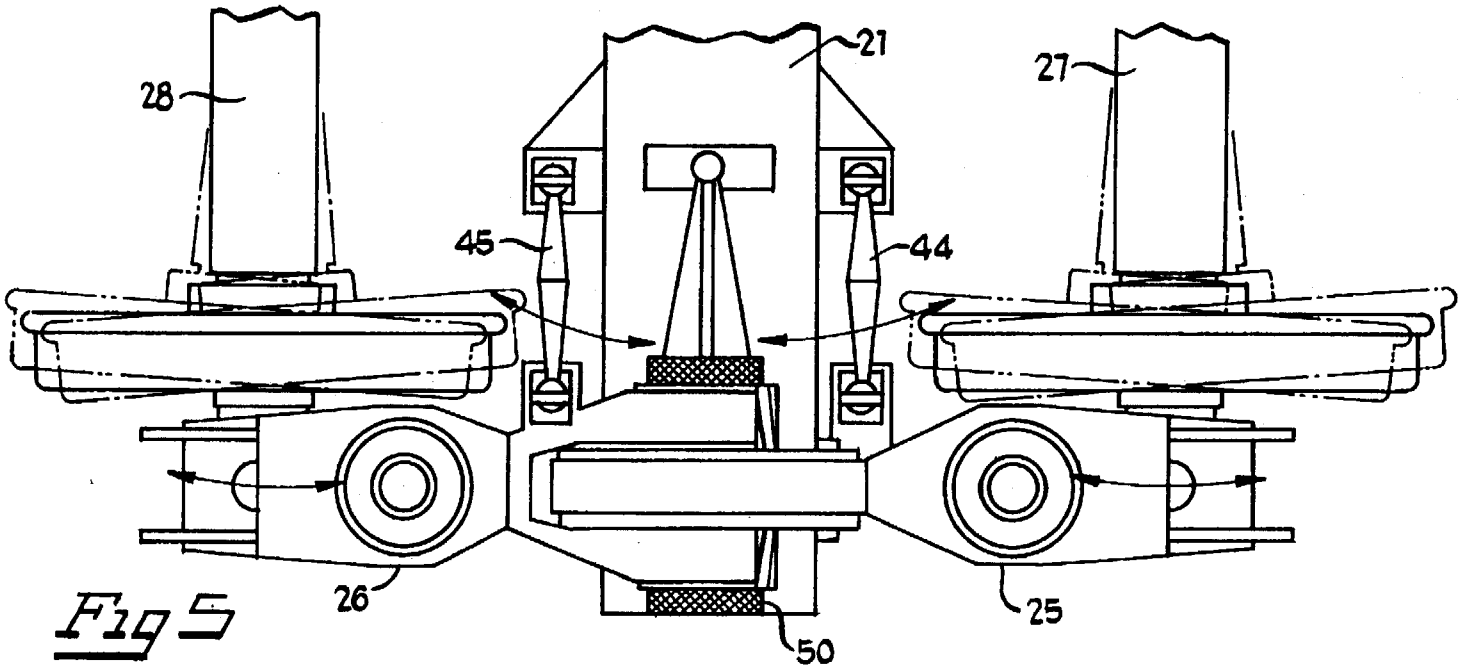
FIG. 5 is a fragmentary top plan view of the linear steering truck, according to the present invention, showing the axle movement capability of the truck.

As may be readily perceived, the truck positioned at the rear of the car body would be mounted in an orientation rotated 180 degrees, from that illustrated in FIG. 1, since the rear truck would rotate counterclockwise to the car body, for a right turn relative to the indicated direction of travel. As the car body leaves the curve to resume straight travel, the front truck (FIG. 1) will be rotated counterclockwise relative to the car body, and the previously described movements will be reversed, until the neutral position illustrated in FIG. 1 is attained. The overall range and pattern of movements of the prompting mechanism for axles 27 and 28 is suggested by FIG. 5, in which the neutral positions of axles 27 and 28 and the corresponding wheels are indicated by the solid line illustration while the pivoted positions are indicated by the phantom lines.

Figure 6:
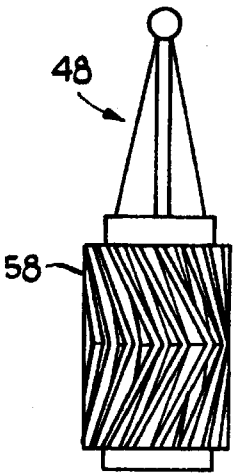
FIG. 6 is a fragmentary plan view of a portion of the prompting apparatus.

The rack portions of the pedestals are not rigidly held in place on the gears. This is to enable the pedestals to pivot, in a horizontal plane, about vertical axes extending upwardly through the respective pinions. Lateral struts 42–45, being pivotably mounted at their ends, assist in guiding and supporting the pedestals in their horizontal pivoting movements. To further accommodate the horizontal pivoting of the pedestals, each pinion, such as pinion 58 (FIG. 6), has a crowned herringbone configuration, in which the crown describes an arc which is concave toward the center of the truck. This curved crown enables the teeth on the respective racks 55, 57 to maintain a maximized amount of surface area in contact with the pinions.

Figure 7:
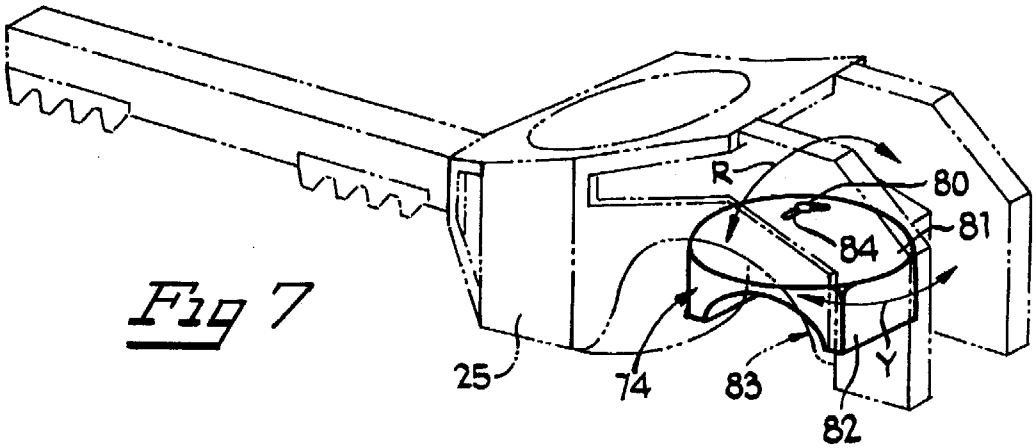
FIG. 7 is a perspective view of the axle bearing adapter apparatus.

The present invention also includes an improved bearing adapter structure which accommodates the various pivoting movements which the axles of the truck of the present invention are expected to make. FIG. 7, for example, illustrates bearing adapter 74, with pedestal 25 being illustrated in phantom as environment.

In a preferred embodiment of the invention, each pedestal, such as pedestal 25, will be provided with a concave, substantially spherical pocket, in the location where, in a conventional truck construction, the roller bearings or other axle bearing members would be received. Preferably, a small cylindrical pin 80, would extend downward from the highest point in the spherical pocket.

Each bearing adapter 74, 75, would be constructed as having two major portions. The upper portion 81, would have a convex, generally spherical contour. The lower portion 82, would have a generally U-shaped configuration, suitably formed for holding a conventional rail axle bearing structure, such as the cylindrical axle bearings 72 as illustrated. Accordingly, lower portion 82, in the embodiment illustrated, will have a semi-cylindrical channel 83 extending from one side to the other of lower portion 82. Preferably, portions 81 and 82 would be formed as a single piece of material. An arcuate slot 84 will be formed in the upper portion 81, having a depth at least as great as the length of pin 80, and a width slightly greater than the diameter of pin 80. Slot 84 will generally extend in a plane parallel to channel 83.

In operation, once truck 20 has been set down upon its corresponding wheel sets, and the cylindrical bearings received in channels 83, the bearing adapters 74, 75, etc., will accommodate pivoting movement of the axles in all directions. For example, as arrow Y indicates, when an axle "goes radial", it will pivot to and from a position perpendicular to the lengthwise axis of its respective pedestal, generally in a horizontal plane. Alternatively, adapter 74 is also configured to accommodate pivoting of an axle about an axis extending parallel to the lengthwise axis of the pedestals, as indicated by arrow R. Such pivoting may occur, when banked or otherwise uneven rails are encountered, and the pedestals of one side of the truck are forced to pivot upwardly, around their respective pinion.

The present invention is also advantageously configured to maintain enhanced linearity during so-called "bump steering." "Bump steering" refers to longitudinal displacement of one or more of the axles, which is induced by vertical displacement of an individual wheel. Such vertical displacement may be the result of joints between successive rail sections, flaws in the track, etc. The suspension geometry of the truck apparatus of the present invention is configured to reduce the amount of longitudinal displacement which occurs during a bump.

A significant feature which enables the "bump steering" to have improved linearity, is that the truck suspension is configured in such a way that, for an empty car resting on level track, the centerlines of the axles of the truck will be below the top of the pinion.

Figure 17:
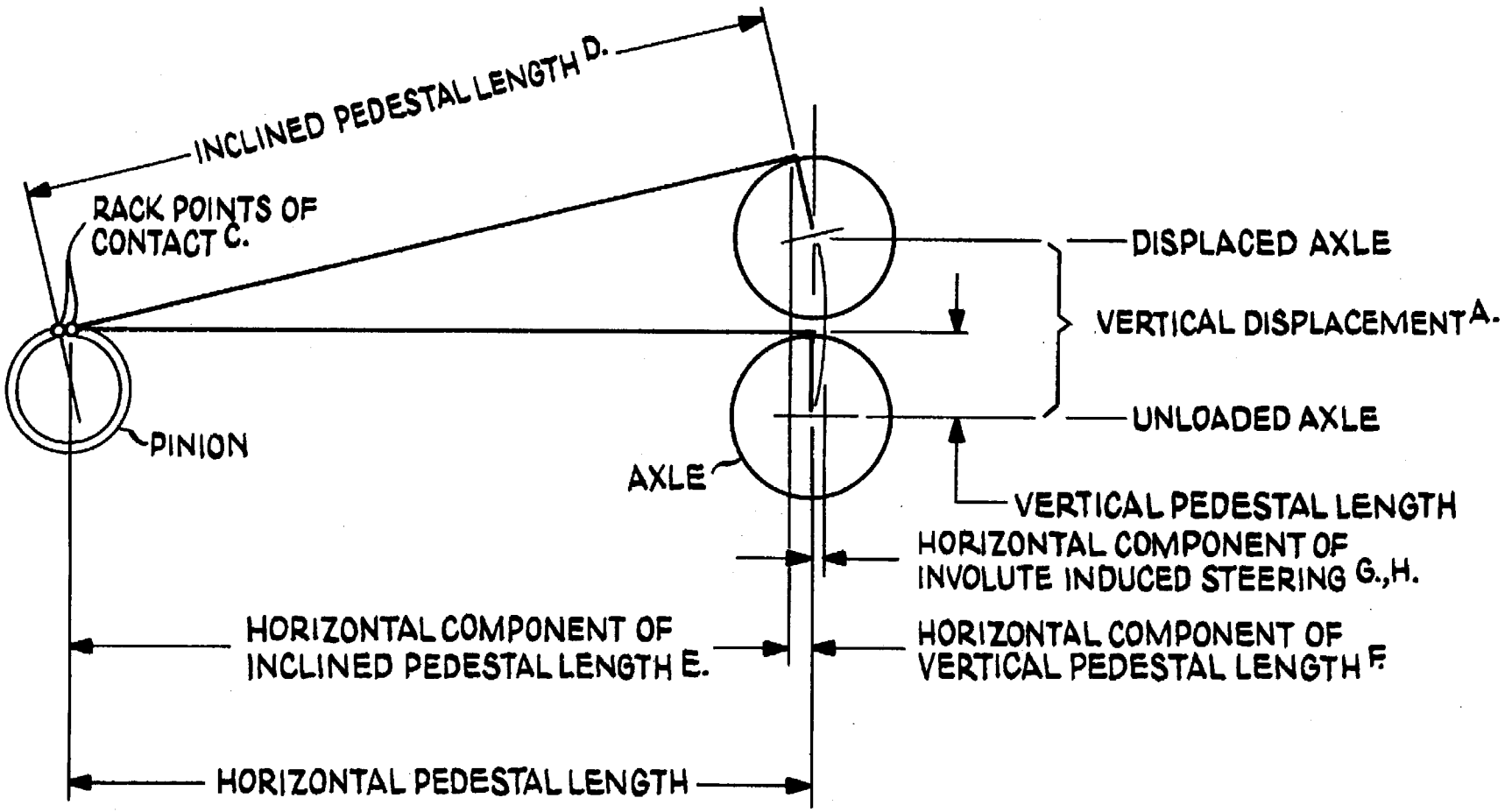
FIG. 17 is a schematic illustration of the mechanics of "bump steering" of a truck configured according to the principles of the present invention, in which an axle corresponding to a pinion rack is vertically displaced.
Figure 18:
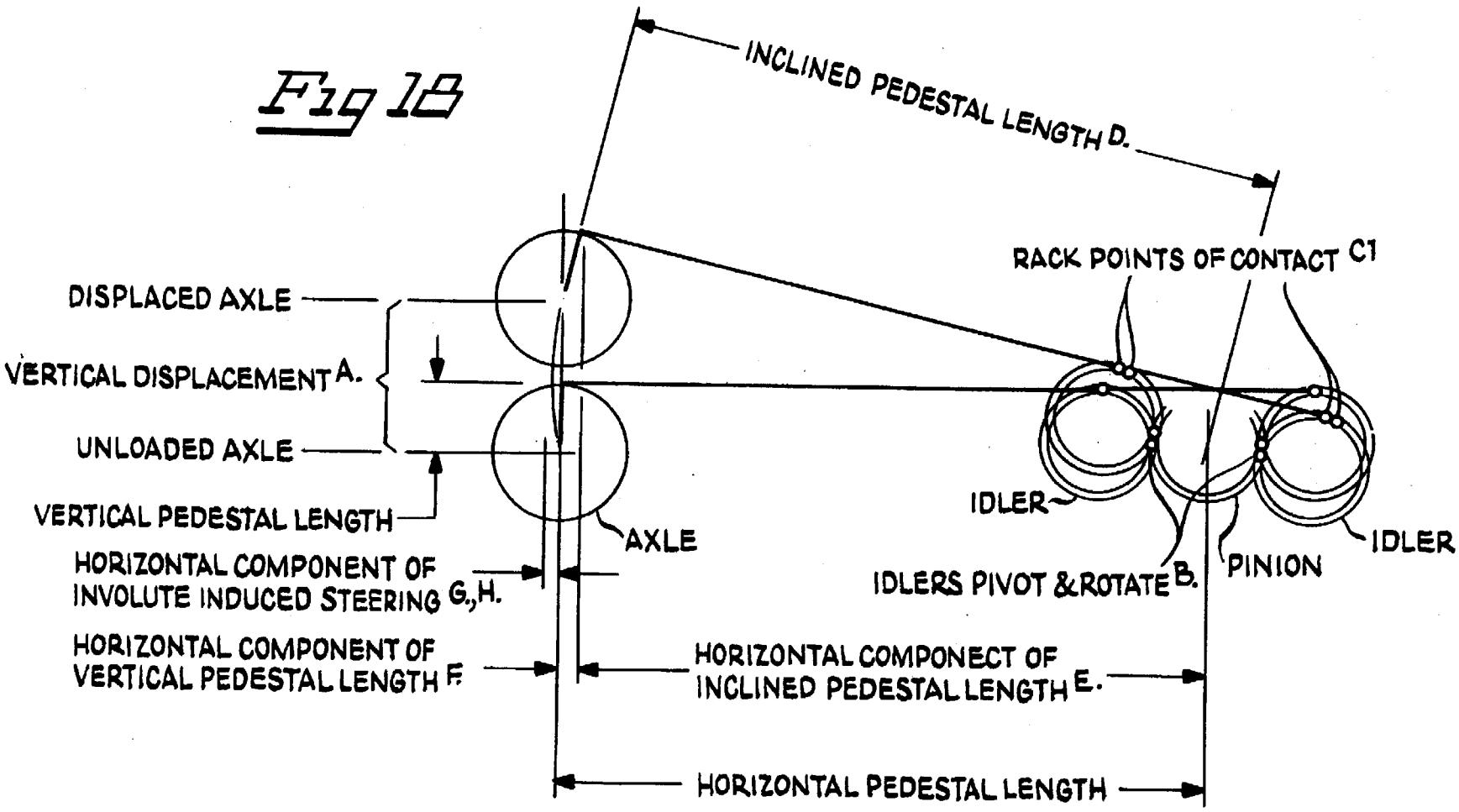
FIG. 18 is a schematic illustration of the mechanics of "bump steering" of a truck configured according to the principles of the present invention, in which an axle corresponding to an idler rack is vertically displaced.

The mechanics of "bump steering" are illustrated in the schematic illustrations of FIGS. 17 and 18. The steps are as follows:

A) The axle is vertically displaced as a result of some generally upward force on the respective wheel;

B) The idlers pivot and rotate relative to the pinion;

C) The pinion rack rolls and pivots on the pinion changing the point of contact (FIG. 17), or;

C1) The idler rack rolls on the idler changing the point of contact (FIG. 18);

D) The inclined pedestal length is greater than the horizontal pedestal length by an amount equal to the rack rolling length;

E) Pivoting out of plane foreshortens the horizontal components of the inclined pedestal length;

F) Pivoting out of plane increases the horizontal component of the vertical pedestal length;

G) The sum of the rack rolling length, and the horizontal components of the pedestal inclined length and the vertical pedestal lengths describe an axle involute motion.

H) Optimizing the vertical pedestal length (utilizing otherwise conventional design techniques) minimizes the horizontal components of the involute described by the axle during the bump motion.

The vertical displacement which is to be provided between the axle centerlines and the tops of the gears will depend upon the size and anticipated loading of the truck, and the duty the truck will be expected to perform, and may be readily determined utilizing conventional design techniques by one of ordinary skill in the art having the present disclosure before them.

The embodiments of the invention which are described and illustrated in FIGS. 1–17, provide for the improved controlled steering of a railroad truck through curves, with a substantially more linear response to the steering input to the truck provided by a rotational change in position of a truck 20 relative to the car body to which it is attached, than has been heretofore believed possible. That is, the amount of displacement of the axle ends to radially align the axles of a truck, per unit of rotation of the truck relative to the car body, is substantially uniform throughout the possible range of movement of the axles that would result from a long rail car with, for example, 66 foot truck centers negotiating curves having radii of curvature of 2865 to 716 feet. It is contemplated that the deviation of the present invention from perfect steering in such situations would only be of the order of magnitude of 0.0005 inches of axle displacement from perfectly radially aligned axles. (The output movement is essentially a linear function of the input movement, relative to the magnitudes of movements involved.) This linearity of movement assures even and controlled steering, for enhanced efficiency, reduced wear and stability in curves.

The steerable truck apparatus according to the present invention is further believed to possess the advantage, by virtue of its symmetrical configuration, of having a uniform loading of forces on its structure, providing for uniform stress management, uniform wear and uniform response during operation.

The steerable truck according to the present disclosure is adaptable for use with both non-powered trucks (as illustrated) and powered trucks, with the adaptation for powered trucks being readily accomplished by one of ordinary skill in the art having the present disclosure before them.

The foregoing description and drawings merely serve to illustrate the invention and the invention is not limited thereto except insofar as the appended claims are so limited, as those skilled in the art who have the disclosure before them will be able to make modifications and variations therein without departing from the scope of the invention.

What is claimed is:

1. A steerable truck apparatus, for mounting upon a railroad car body, the steerable truck apparatus being of the kind having at least two transversely extending axles, and being pivotably mountable to the railroad car body, the steerable truck apparatus having a longitudinally extending axis in the direction of travel of the truck when the truck is travelling in a straight line, the steerable truck axis further having a transverse axis extending generally perpendicular to the longitudinal axis, the steerable truck apparatus comprising:

a bolster member, having two ends;

means for pivotable connecting the bolster member to the car body, such that when the railroad car is on straight tracks, the bolster member is disposed in a neutral position extending transversely to the tracks, the means for pivotably connecting the bolster being operably configured to enable the truck to pivot about a vertical axis which intersects the intersection of the longitudinal axis and the transverse axis, and is perpendicular to each of the longitudinal axis and the transverse axis;

two side frame members, disposed at the ends of the bolster member, in substantially fixed orientation to the bolster member, against movement in a plane extending perpendicular to the vertical axis, and extending substantially perpendicular to the bolster member;

a plurality of axle bearing support members, positioned in corresponding pairs on opposed sides of the truck, each axle bearing support member receiving an end of one of the at least two axles, corresponding ones of the corresponding pairs of axle bearing support members being positioned substantially below respective ones of the two side frame members, the axle bearing support members being further operably arranged in cooperating pairs, each cooperating pair including a first axle bearing support member positioned on a first end of a first of the at least two axles, and a second axle bearing support member positioned on a first end of a second of the at least two axles, each cooperating pair of axle bearing support members being disposed on a common side of the truck, relative to the longitudinal axis;

means, operably associated with the axle bearing support members, for prompting the at least two axles to pivot, in a coordinated manner, about two respective axes, when the radius of curvature of the track upon which the railroad car is travelling changes;

the two respective axis being parallel to, and in longitudinally spaced relation to the vertical axis, such that the vertical axis is disposed at position midway between the two respective axes;

the prompting means being configured to pivot the at least two axles simultaneously in opposite directions about their respective two axes, toward prompting the orientation of the at least two axles into radial positions relative to the center of curvature of the track upon which the railroad car is travelling;

the prompting means being further operably configured to receive an input in response to changes in the curvature of the track upon which the railroad car is travelling, the prompting means further being operably configured to produce an output pivoting movement of the axles, the magnitude of which is a substantially linear function of the input;

a plurality of spring support members, each spring support member being interposed between a respective axle bearing support member and one of the side frame members, in a load-bearing relationship between the axle bearing support member and the respective side frame member, the prompting means further comprising two torque members, operably supported for substantially free rotational movement about an axis disposed substantially parallel to the transversely extending axis and at substantially a midpoint along the longitudinal axis, the two torque members being disposed upon laterally opposed portions of the truck apparatus, substantially coaxially with one another;

two pinion members, operably affixed to the respective laterally outer ends of the two torque members;

at least one idler gear member being rotatably supported adjacent and in driven engagement with a respective one of the two pinion members such that upon rotation of a pinion, the corresponding respective at least one idler gear is constrained to rotate in a direction opposite the direction of rotation of the pinion;

a pinion rack member, affixed to one axle bearing support member of each cooperating pair and extending from the axle bearing support member toward the transversely extending axis, and operably disposed in driven engagement with one of the respective pinon members;

an idler rack member, affixed to one axle bearing support member of each cooperating pair and extending from the axle bearing support member toward the transversely extending axis, and operably disposed in driven engagement with the at least one idler gear member corresponding to the respective pinion member, such that upon rotation of the respective pinion members, the corresponding respective pinion rack member and idler rack member, and in turn the axle bearing support members of the respective cooperating pair, will be driven in substantially opposite directions.

2. The steerable truck apparatus according to claim 1, further comprising:

two thrust members, each thrust member having two ends, a first end affixed to the car body and a second end affixed to one of the two torque members, the thrust members being operably disposed so that when the track upon which the railroad car travels undergoes a change of curvature, pivoting of the car body relative to the truck apparatus causes one thrust member to rotate one torque member in a first direction about its axis and the other thrust member rotates the other torque member in a second, opposite direction, in an amount equal in magnitude to the rotation of the first torque member.

3. The steerable truck apparatus according to claim 2, further comprising means for accommodating precessional movement of the axles, operably associated with at least one corresponding pair of axle bearing support members.

4. The steerable truck apparatus according to claim 3, wherein the means for accommodating precessional movement of the axles comprises:

a bearing adapter member, operably interposed between the axle and each axle bearing support member of the at least one corresponding pair of axle bearing support member, and operably configured to permit both vertical and horizontal pivoting of the axle with respect to the axle bearing support member at each end of the axle.

5. The steerable truck apparatus according to claim 1, further comprising steering oscillation control means, operably associated with the prompting means, for substantially precluding undesired oscillation of the prompting means, when the railroad car is travelling over substantially straight track.

6. The steerable truck apparatus according to claim 5, wherein the steering oscillation control means comprises:

a resilient thrust damping member, operably interposed between each thrust member and its respective torque member.

7. The steerable truck apparatus according to claim 5, wherein the steering oscillation control means comprises:

a resilient thrust damping member, operably interposed between the car body and each torque member.

8. A steerable truck apparatus, for mounting upon a railroad car body, the steerable truck apparatus being of the kind having two transversely extending axles, and being pivotably mountable to the railroad car body, the steerable truck apparatus having a longitudinally extending axis in the direction of travel of the truck when the truck is travelling in a straight line, the steerable truck axis further having a transverse axis extending generally perpendicular to the longitudinal axis, the steerable truck apparatus comprising:

a plurality of axle bearing support members, positioned in corresponding pairs on opposed sides of the truck, each axle bearing support member receiving an end of one of the axles, the axle bearing support members being further operably arranged in cooperating pairs, each cooperating pair including a first axle bearing support member positioned on a first end of a first of the at least two axles, and a second axle bearing support member positioned on a first end of a second of the at least two axles, each cooperating pair of axle bearing support members being disposed on a common side of the truck, relative to the longitudinal axis;

two torque members, operably supported for substantially free rotational movement about an axis disposed substantially parallel to the transversely extending axis and at substantially a midpoint location along the longitudinal axis, the two torque members being disposed upon laterally opposed portions of the truck apparatus, substantially coaxially with one another;

two pinion members, operably affixed to the respective laterally outer ends of the two torque members;

at least one idler gear member being rotatably supported adjacent and in driven engagement with a respective one of the two pinion members such that upon rotation of a pinion, the corresponding respective at least one idler gear is constrained to rotate in a direction opposite the direction of rotation of the pinion;

a pinion rack member, affixed to one axle bearing support member of each cooperating pair and extending from the axle bearing support member toward the transversely extending axis, and operably disposed in driven engagement with one of the respective pinion members;

an idler rack member, affixed to one axle bearing support member of each cooperating pair and extending from the axles bearing support member toward the transversely extending axis, and operably disposed in driven engagement with the at least one idler gear member corresponding to the respective pinion member, such that upon rotation of the respective pinion members, the corresponding respective pinion rack member and idler rack member, and in turn the axle bearing support members of the respective cooperating pair, will be driven in substantially opposite directions, toward prompting the orientation of the at least two axles into radial positions relative to the center of curvature of the track upon which the railroad car is travelling.

9. The steerable truck apparatus according to claim 9, further comprising:

two thrust members, each thrust member having two ends, a first end affixed to the car body and a second end affixed to one of the two torque members, the thrust members being operably disposed so that when the track upon which the railroad car travels undergoes a change of curvature, pivoting of the car body relative to the truck apparatus causes one thrust member to rotate one torque member in a first direction about its axis and the other thrust member rotates the other torque member in a second, opposite direction, in an amount equal in magnitude to the rotation of the first torque member.

10. The steerable truck apparatus according to claim 9, further comprising:

a bolster member, having two ends;

means for pivotably connecting the bolster member to the car body, such that when the railroad car is on straight tracks, the bolster member is disposed in a neutral position extending transversely to the tracks, the means for pivotably connecting the bolster being operably configured to enable the truck to pivot about a vertical axis which intersects the intersection of the longitudinal axis and the transverse axis, and is perpendicular to each of the longitudinal axis and the transverse axis;

two side frame members, disposed at the ends of the bolster member, in substantially fixed orientation to the bolster member, against movement in a plane extending perpendicular to the vertical axis, and extending substantially perpendicular to the bolster member; and a plurality of spring support members, each spring support member being interposed between a respective axle bearing support member and one of the side frame members, in a load-bearing relationship between the axle bearing support member and the respective side frame member.

11. The steerable truck apparatus according to claim 10, further comprising steering oscillation control means, operably associated with the prompting means, for substantially precluding undesired oscillation of the prompting means, when the railroad car is travelling over substantially straight track.

12. The steerable truck apparatus according to claim 11, wherein the steering oscillation control means comprises:

a resilient thrust damping member, operably interposed between each thrust member and its respective torque member.

13. The steerable truck apparatus according to claim 11, wherein the steering oscillation control means comprises:

a resilient thrust damping member, operably interposed between the car body and each torque member.

14. The steerable truck apparatus according to claim 10, wherein at least one of the axle bearing support members is operably configured to pivot, in a plane extending substantially horizontally, during said driven movement of said axle bearing support member, the steerable truck apparatus further comprising guide means, operably associated with the at least one axle bearing support member and the bolster member, for operably constraining the movement of the at least one axle bearing support member to a substantially predetermined arc of movement.

15. The steerable truck apparatus according to claim 14, wherein the guide means comprises:

at least one lateral strut member operably connecting the bolster member and the at least one axle bearing support member, the at least one lateral strut member further having a first end and a second end;

a pocket operably disposed on the bolster member, operably configured for receiving one of the first and second ends, the pocket further being operably configured for accommodating precessional movement of the at least one lateral strut member, relative to the bolster member;

a pocket operably disposed on the at least one axle bearing support member, operably configured for receiving the other of the first and second ends, the pocket further being operably configured for accommodating precessional movement of the at least one lateral strut member, relative to the at least one axle bearing support member.

16. The steerable truck apparatus according to claim 15, wherein the first and second ends of the lateral strut members have substantially spherical configurations, and the pockets on the bolster and the at least one axle bearing support member each include at least one substantially concave shoe member for receiving at least a portion of one of the first and second ends of the lateral strut members.

17. The steerable truck apparatus according to claim 8, further comprising means for accommodating precessional movement of the axles, operably associated with at least one corresponding pair of axle bearing support members.

18. The steerable truck apparatus according to claim 17, wherein the means for accommodating precessional movement of the axles comprises:

a bearing adapter member, operably interposed between the axle and each axle bearing support member of the at least one corresponding pair of axle bearing support member, and operably configured to permit both vertical and horizontal pivoting of the axle with respect to the axle bearing support member at each end of the axle.

19. The steerable truck apparatus according to claim 8, further comprising:

at least one of the pinion members having first and second ends, and a circumferential surface extending around a longitudinal axis, with at least one set of first gear teeth disposed on the circumferential surface at a position substantially midway between the first and second ends, for engaging the at least one idler gear member, and at least one set of second gear teeth positioned substantially adjacent at least one of the first and second ends of the pinion member, at a position angularly removed about the circumference from the at least one set of first gear teeth, for engaging the pinion rack member; and the at least one idler gear member having a circumferential surface, and first set of gear teeth, for engaging the idler rack member, and a second set of gear teeth operably disposed at a position angularly removed about the circumference from the first set of gear teeth, for engaging the pinion member.

* * * * *

UNITED STATES PATENT AND TRADEMARK OFFICE

CERTIFICATE OF CORRECTION

PATENT NO. : 5,666,885
DATED : September 16, 1997
INVENTOR(S) : Paul S. Wike

It is certified that error appears in the above-indentified patent and that said Letters Patent is hereby corrected as shown below:

Col. 4, Line 7 delete Fig. "A" and instead insert Fig. "4A".

Col. 5, Line 16 delete "Pinties" and instead insert "Pintles".

Col. 9, Line 40 delete "pinties" and instead insert "pintles".

Col. 9, Line 52 delete "21 2" and instead insert "212".

Col. 18, Line 38 delete "Claim 9" and instead insert "Claim 8".

Signed and Sealed this

Twenty-second Day of December, 1998

Bruce Lehman

*Attest:*

BRUCE LEHMAN

*Attesting Officer*

*Commissioner of Patents and Trademarks*